US006863807B2

(12) United States Patent
Crawford, III

(10) Patent No.: US 6,863,807 B2
(45) Date of Patent: Mar. 8, 2005

(54) METHOD AND APPARATUS FOR REMEDIATION AND PREVENTION OF FOULING OF RECIRCULATING WATER SYSTEMS BY DETRITUS AND OTHER DEBRIS

(76) Inventor: William Randall Crawford, III, 255 Marina Dr., Long Beach, CA (US) 90803

( * ) Notice: Subject to any disclaimer, the term of this patent is extended or adjusted under 35 U.S.C. 154(b) by 0 days.

(21) Appl. No.: 10/670,654

(22) Filed: Sep. 24, 2003

(65) Prior Publication Data

US 2004/0057839 A1 Mar. 25, 2004

Related U.S. Application Data

(60) Provisional application No. 60/413,762, filed on Sep. 25, 2002.

(51) Int. Cl.[7] ..... B01D 35/02

(52) U.S. Cl. ..... 210/170; 210/747; 210/196; 210/241; 210/416.1; 405/36; 405/116

(58) Field of Search ..... 210/747, 170, 210/196, 197, 241, 416.1; 405/36, 107, 108, 116, 127

(56) References Cited

U.S. PATENT DOCUMENTS

| | | | | | |
|---|---|---|---|---|---|
| 1,611,478 | A | * | 12/1926 | Massey | 406/156 |
| 2,044,088 | A | * | 6/1936 | Lord | 417/151 |
| 3,010,232 | A | * | 11/1961 | Skakel et al. | 37/195 |
| 3,191,206 | A | * | 6/1965 | Hamel | 15/1.7 |
| 3,262,571 | A | * | 7/1966 | Petretti | 210/297 |
| 3,563,607 | A | * | 2/1971 | Boyle | 299/9 |
| 4,159,248 | A | * | 6/1979 | Taylor et al. | 210/96.1 |
| 4,316,680 | A | * | 2/1982 | Phipps et al. | 406/49 |
| 4,352,251 | A | * | 10/1982 | Sloan | 37/323 |
| 4,413,433 | A | * | 11/1983 | Duverne | 37/190 |
| 4,681,372 | A | * | 7/1987 | McClure | 299/8 |
| 4,756,671 | A | * | 7/1988 | Grimes et al. | 417/53 |
| 4,807,373 | A | * | 2/1989 | Sloan et al. | 37/322 |
| 4,854,058 | A | * | 8/1989 | Sloan et al. | 37/323 |
| 4,929,353 | A | * | 5/1990 | Harris | 210/237 |
| 4,943,211 | A | * | 7/1990 | Boegh | 417/181 |
| 5,052,855 | A | * | 10/1991 | Chapman et al. | 405/36 |
| 5,073,258 | A | * | 12/1991 | Boullain, II et al. | 210/172 |
| 5,129,167 | A | * | 7/1992 | Nakahara | 37/318 |
| 5,227,067 | A | * | 7/1993 | Runyon | 210/606 |
| 5,314,619 | A | * | 5/1994 | Runyon | 210/606 |
| 6,145,223 | A | * | 11/2000 | Flesen | 37/317 |
| 6,447,205 | B1 | * | 9/2002 | Pawluk | 405/74 |
| 2004/0057839 | A1 | * | 3/2004 | Crawford, III | 417/87 |

* cited by examiner

*Primary Examiner*—Robert James Popovics
(74) *Attorney, Agent, or Firm*—Bruce H. Johnsonbaugh

(57) ABSTRACT

An apparatus and method are provided for removing accumulated underwater debris from a reservoir for a recirculating water system, such as used for a golf course sprinkler system. An eductor is provided which is driven by a high pressure water pump. The high pressure creates a vacuum which is utilized to actuate a vacuum line. The vacuum line is moved to and fro in the reservoir to entrain the debris from the reservoir in water and to carry the entrained debris to the eductor. The entrained debris is discharged from the eductor into a separator having a permeable membrane which traps the debris and allows the water to return to the reservoir. Various separators are provided. The eductor includes an adjustably mounted nozzle to adapt to different sized debris being removed from the reservoir.

21 Claims, 32 Drawing Sheets

METHOD AND APPARATUS FOR REMEDIATION AND PREVENTION OF FOULING OF RECIRCULATING WATER SYSTEMS BY DETRITUS AND OTHER DEBRIS

CROSS-REFERENCE TO RELATED APPLICATION

This application claims the benefit of and priority from U.S. provisional application Ser. No. 60/413,762 filed Sep. 25, 2002.

BACKGROUND AND BRIEF SUMMARY OF INVENTION

The present invention relates generally to maintenance of large scale recirculating water systems. In particular, the present invention provides a method and apparatus for removal of accumulated sand, silt, detritus, algae and other debris from golf course recirculating water and irrigation systems. A related application of the invention is for maintenance of recirculating water systems used, for example, in ponds, water fountains and decorative pools.

Typical golf course recirculating sprinkler systems will pump 750,000 to 2,500,000 gallons per night during the warm season through a system of 2,000 to 2,400 sprinkler heads. Most golf courses are designed so that lakes or water hazards are primary storage reservoirs for the sprinkler systems. A golf course lake or water hazard functioning as a primary storage reservoir will typically have an intake positioned near the bottom of the reservoir. A gravity feed line or a pump will transfer water from the water reservoir to a "wet well." The "wet well" is typically a concrete lined structure which serves as a secondary reservoir, from which one or more large pumps will pump water to the sprinkler heads. A pump house is normally built over each "wet well." A typical golf course will have from 1 to 4 primary reservoirs, each of which has its own "wet well." A typical "wet well" will have 1 to 4 separate pumps pumping water from it to the sprinkler system.

Most golf courses use what is known as "tertiary cleansed" (also referred to as recycled) water, as opposed to potable water. The tertiary cleansed (or recycled) water is supplied by a local water district and typically introduced into the primary storage reservoir or reservoirs. The economics of using recycled water on a golf course can be quite profound. The cost of recycled water is typically 40% of the cost of potable water available from a municipal water supply. A typical golf course saves approximately $2,000 per day during the warm season by utilizing recycled water as opposed to potable municipal water.

The problem with existing recirculating water systems for golf courses is that over time, detritus, golf balls, algae and all manner of debris accumulate in the water and on the bottom of the water hazard or lake that is used as the primary reservoir for the sprinkler system. In addition, algae in many situations tends to collect around the grating used on typical existing water intakes. To make matters worse, sand, silt and other fine particulate matter over time tends to enter the intake and become entrained in the water pumped through the pumping station and throughout the sprinkler lines of the entire golf course. The financial ramifications of allowing this process to continue unabated can be catastrophic. For example, if a water hazard acting as a primary reservoir has to be cleaned, the prior art systems typically require the golf course operator to close down operation of the golf course and drain the water hazard acting as the primary reservoir.

Machines such as backhoes or loaders then enter the drained water hazard and remove the accumulated detritus and other debris such as twigs, golf balls, rocks, etc. During this process, it is not unusual for rather serious damage to be caused to the turf around the water hazard acting as the primary reservoir due to the access required by the rather heavy machines that must enter the drained water hazard. The cost of draining and cleaning a water hazard can run from $300,000 to $500,000. In addition to these out-of-pocket expenses, the golf course operator often suffers the additional expense of shutting down the golf course as well as expense of replacing turf and vegetation that dies while the irrigation system is closed down. Some golf courses may remain open by using the more expensive potable water (if available) and paying the increased cost.

In addition to the cost of cleaning a water hazard acting as a pimary reservoir for the irrigation system, additional expensive damage may be caused to the pumping system and sprinkling system by the unabated accumulation of detritus and other debris allowed to enter the pumping and sprinkling system. For example, sand or algae that is allowed to enter the sprinkler system can require the replacement of all sprinkler heads at a cost of appoximately $250,000. In addition to the replacement cost of sprinkler heads, there are additional costs of turf and vegetation which dies as a result of fouled sprinkler heads. A further complication is that some fouled sprinkler heads remain open and cause localized flooding. Localized flooding can require shutdown of a portion of or the entire golf course. Additional damage may be done to the large pumps utilized to supply water from the "wet wells" to the sprinkler system and to pumps transferring water from the primary reservoir into the "wet well" or secondary storage reservoir. Typical golf courses have one or more pump stations, each of which utilizes a total of 1 to 4 pumps. Replacement of one of those pumps costs approximately $85,000 plus shutdown time. Another danger in those installations where pumps are used to transfer water from the water hazard/primary reservoir to the "wet well" is that the screens at the intake become clogged with algae and the pumps cavitate. The cavitation can cause the pumps to burn out, requiring their replacement.

Many of the above problems described for typical golf course recirculating sprinkler systems are also experienced in systems which recirculate water in ornamental pools, water fountains, ponds and the like. Those systems typically involve intakes positioned in a primary reservoir and pumping systems which pump water from the intake either through fountains, waterfalls or transfer water to a higher level from whence it flows back to the primary reservoir. The typical cleanup of an ornamental pool whose recirculating water system has become fouled by sand, detritus and other debris is similar to that required for golf courses. The owner must shut the system down, drain the primary reservoir, remove the sand, detritus and other debris, refill the system with water and replace any vegetation that has died during the process.

According to the present invention, a method and apparatus are provided for remediation of recirculating water systems that have begun to accumulate sand, detritus, algae and other debris in the intake system and pumping stations. The present invention also provides a relatively low cost preventive maintenance system which, when utilized periodically, avoids the dangerous buildup of sand, detritus and other debris, all without violating the integrity of the surroundings and without disrupting operation of the golf course or fountain or decorative pool involved.

According to the present invention, a portable system has been developed which can readily be delivered to the shore of a water hazard/primary reservoir in a lightweight truck. The apparatus includes a hydraulically actuated vacuum nozzle, preferably having a three inch diameter intake line. This vacuum intake is carried into the water hazard/primary reservoir by a qualified diver. The diver moves the hydraulic vacuum nozzle to and fro and the nozzle sucks up the sediment and debris around the region of the water system intake. The vacuum nozzle also completely removes any algae or other matter adhering to and tending to block the water system intake. The sediment and debris flow upwardly through the nozzle and through an eductor system wherein the eductor nozzle is fed by water pumped directly from the water hazard/reservoir into the eductor. The entrained sediment and debris and water are pumped into a temporary, permeable dam which has been erected on the shore of the water hazard/reservoir. The temporary, permeable dam (i.e. separation means) may include multiple concentric, generally circular (or other enclosed shape) dams. The sediment and debris collect within the walls of the temporary and permeable dam (or dams); and relatively clarified water passes through the permeable dam (or dams) and re-enters the water hazard/primary reservoir. After the required sediment and debris have been removed from the water hazard/primary reservoir, the debris and sediment collected within the permeable dam structure are transported to a suitable disposal site. Alternately, in some facilities, it is possible to pump the entrained debris directly into a dump truck (or other vehicle or trailer) adjacent the water hazard/primary reservoir, wherein the dump truck bed is outfitted with a permeable membrane whereby the detritus and debris collect in the bed of the truck and the dump truck transports the accumulated detritus and debris to a disposal site without the sediment and debris having to collect on the ground. In similar fashion, the qualified diver enters the wet well and uses the hydraulic vacuum nozzle to collect sediment and debris (including algae) which tend to collect around the wet well pump intakes. The pump intake screens are cleaned at the same time.

The preferred embodiment of the present invention (with two workmen) is capable of cleaning and removing accumulated debris from one typical golf course primary reservoir and wet well in a single day, provided that the reservoir has been cleaned in the previous 6–8 months. There is no need to suspend operations of the golf course. There is no disruption of the sprinkling system since the water hazard/primary reservoir is not emptied. There is no need to temporarily rely on expensive potable water to temporarily irrigate the golf course. There is no damage done to the water hazard/primary reservoir or to the vegetation surrounding the reservoir. The water hazard/primary reservoir can be cleaned using the present invention for less than 1% of the cost of draining the reservoir and cleaning it as described above. The financial savings to the golf course operators are significant. If the present invention is utilized periodically, the golf course operator can effectively prevent future fouling of the sprinklers and pumps as well as fouling of the main system intake. Similarly, owners of decorative pools, ponds, water fountains and other recirculating water systems can benefit immensely from the present invention. The present invention avoids the necessity of draining such ponds and pools. The present invention avoids the requirement of shutting down the operation of the decorative pools, ponds and fountains and avoids the expense of having to refill those bodies of water with potable, rather expensive, city or municipal water.

Although the invention preferably is used to periodically clean primary reservoirs every six months or so, it can also be effectively used to clean reservoirs that have been neglected for years. For example, golf courses may allow debris to build up for 15–20 years. The debris may be 4–6 feet deep. The present invention can be used effectively in those situations, requiring months (and more than one year in some cases) to clean the primary reservoir. Each in such extreme cases, the present invention is more cost effective than draining the reservoir and bringing in heavy machines to clean out the debris and detritus.

The invention is lightweight and portable, but simultaneously has an enormous capacity. The vacuum nozzle generates a strong vacuum of up to 29 inches of mercury in a three inch vacuum intake or suction hose. This gives the system the capacity of removing up to 9 cubic yards (enough to fill a large dump truck) of sand or light gravel per hour using a specific, lightweight and portable embodiment of the invention. The capacity of removing sludge is about 6 yards per hour using the same embodiment.

It is therefore a primary object of the present invention to provide a method and apparatus for effectively remediating a recirculating water system for golf courses and for large scale decorative ponds and water fountains which have become fouled by sand, silt, detritus, algae and other debris.

A further object of the present invention is to provide a method and apparatus which, when used on a regular periodic basis, will effectively prevent the fouling of recirculating water system intakes, pumps and small nozzles, such as used for golf course sprinklers, fountains and decorative pools.

A further object of the invention is to provide a method and apparatus for remediating and for preventing the fouling of recirculating water systems by sand, silt, detritus, algae and other debris without requiring the system to be shutdown and without requiring the primary reservoir for such system to be drained.

A further object of the present invention is to provide a portable, hydraulic, eductor vacuum for use in removing sand, silt, algae, detritus and other debris from a primary reservoir for a recirculating water system which is capable of generating 29 inches of mercury vacuum in a three inch diameter hydraulic vacuum nozzle.

Another object of the invention is to provide a hydraulic vacuum apparatus portable in a lightweight truck and capable of removing up to 9 cubic yards per hour of sand or light gravel from a primary reservoir for a recirculating water system.

A further object of the present invention is to provide a method and apparatus for removing sand, silt, algae, detritus and other debris from the primary reservoir of a water recirculating system which can be completed in one day at a cost of less than 1 % of draining, cleaning and refilling the primary reservoir by conventional techniques described above; and which is portable in a lightweight truck.

Other objects and advantages of the invention will become apparent from the following description and the drawings wherein:

DETAILED DESCRIPTION OF THE DRAWINGS

FIGS. 1–5 illustrate conceptually how the method and apparatus of the present invention are utilized in conjunction with a golf course recirculating water sprinkler system. It is understood that, although the invention will be described in conjunction with a golf course water recirculating system, the invention is equally applicable to recirculating water systems used for fountains, ponds and decorative pools.

Figure 1:
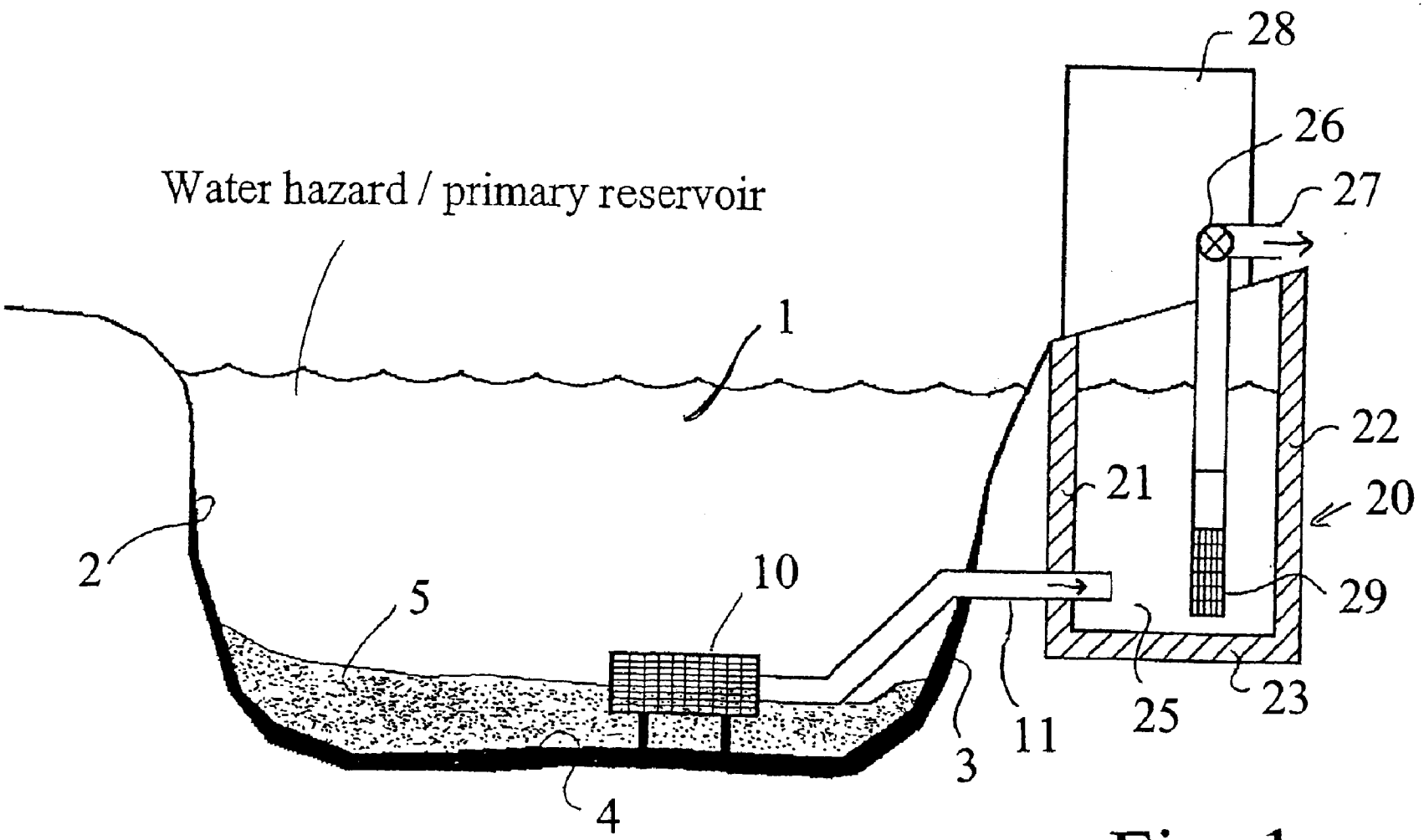
FIG. 1 is a schematic illustration, not to scale, showing a typical golf course water hazard which acts as a primary reservoir for the sprinkler system; the reservoir illustrated in FIG. 1 has an accumulating of silt, sand, detritus and other debris which is fouling the water inlet.

FIG. 1 illustrates a body of water or reservoir 1 bounded by side walls 2 and 3 and bottom 4. The bottom 4 is typically clay, gunite, heavy plastic liner or other hard bottom. A layer of debris 5 (typically sand, silt, detritus and/or gravel) is illustrated which has collected on the reservoir bottom 4 and which has covered a portion of water inlet 10.

A wet well 20 has concrete side walls 21,22 and concrete bottom 23. The purpose of wet well 20 is to store water flowing into it from water reservoir 1 through inlet 10. The water stored in wet well 20 is shown generally as 25 and is pumped from wet well 20 by outlet pump 26 through outlet pipe 27 to sprinkler heads watering the golf course. The wet well 20 is typically covered by pump house 28.

Figure 2:
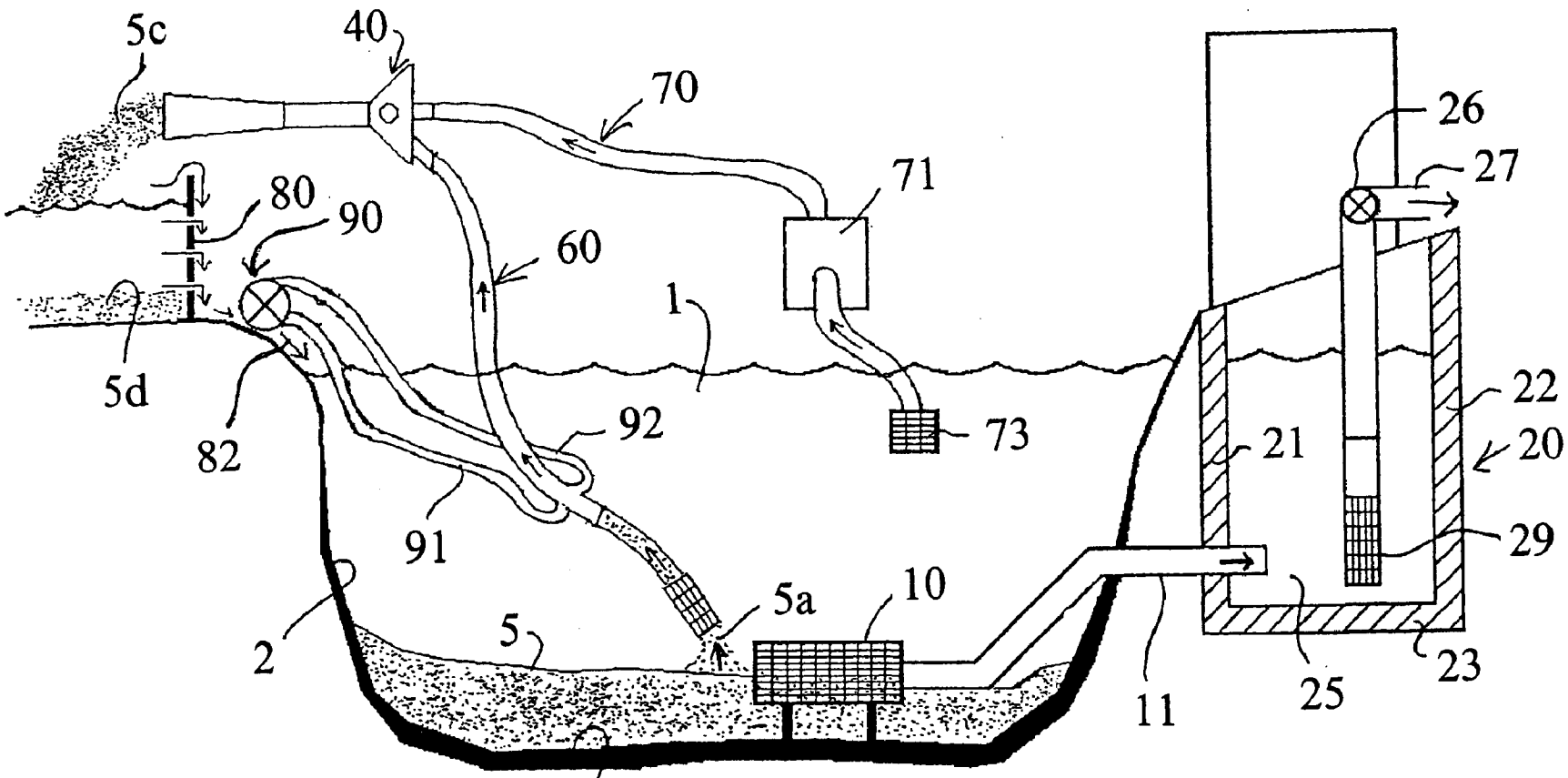
FIG. 2 shows the water hazard of FIG. 1 and also shows schematically the apparatus of the present invention in place and the process of removing sand, silt, detritus and other debris from the bottom of the reservoir has begun.

FIG. 2 illustrates schematically how the present invention is used in conjunction with reservoir 1. The apparatus of the invention includes an eductor shown generally as 40 having a vacuum inlet line shown generally as 60. A high pressure water line 70 also feeds into eductor 40 and introduces water under high pressure through a nozzle described below to generate the vacuum in line 60. Water pump 71 is connected to an inlet line 72 which carries a water inlet 73 at its end. Inlet 73 is a grated or screened inlet which is placed in reservoir 1 to provide a ready source of water to drive eductor 40.

On the shoreline 6 adjacent reservoir 1 a temporary, permeable dam structure 80 is put in place. As a practical matter, permeable dam 80 has side walls and end walls to form a storage and separation chamber or enclosure (i.e. separation means) into which water with entrained debris 5*c* is pumped from eductor 40. Water flows through permeable dam 80, as shown by arrows 82, and returns to reservoir 1.

In operation, a diver enters the reservoir and physically moves the inlet end 61 of the vacuum nozzle 60 to and fro slightly above the surface of detritus and debris 5. As shown in FIG. 2, debris 5*a* is being lifted upwardly into nozzle inlet 61.

An optional injector pump 90 is provided which pumps water from reservoir 1 through injector lines 91 and 92 into vacuum line 60. The purpose of injector pump 90 is to increase the flow rate of material through vacuum line 60 through eductor 40 and to reduce the incidents of clogging eductor 40.

Figure 3:
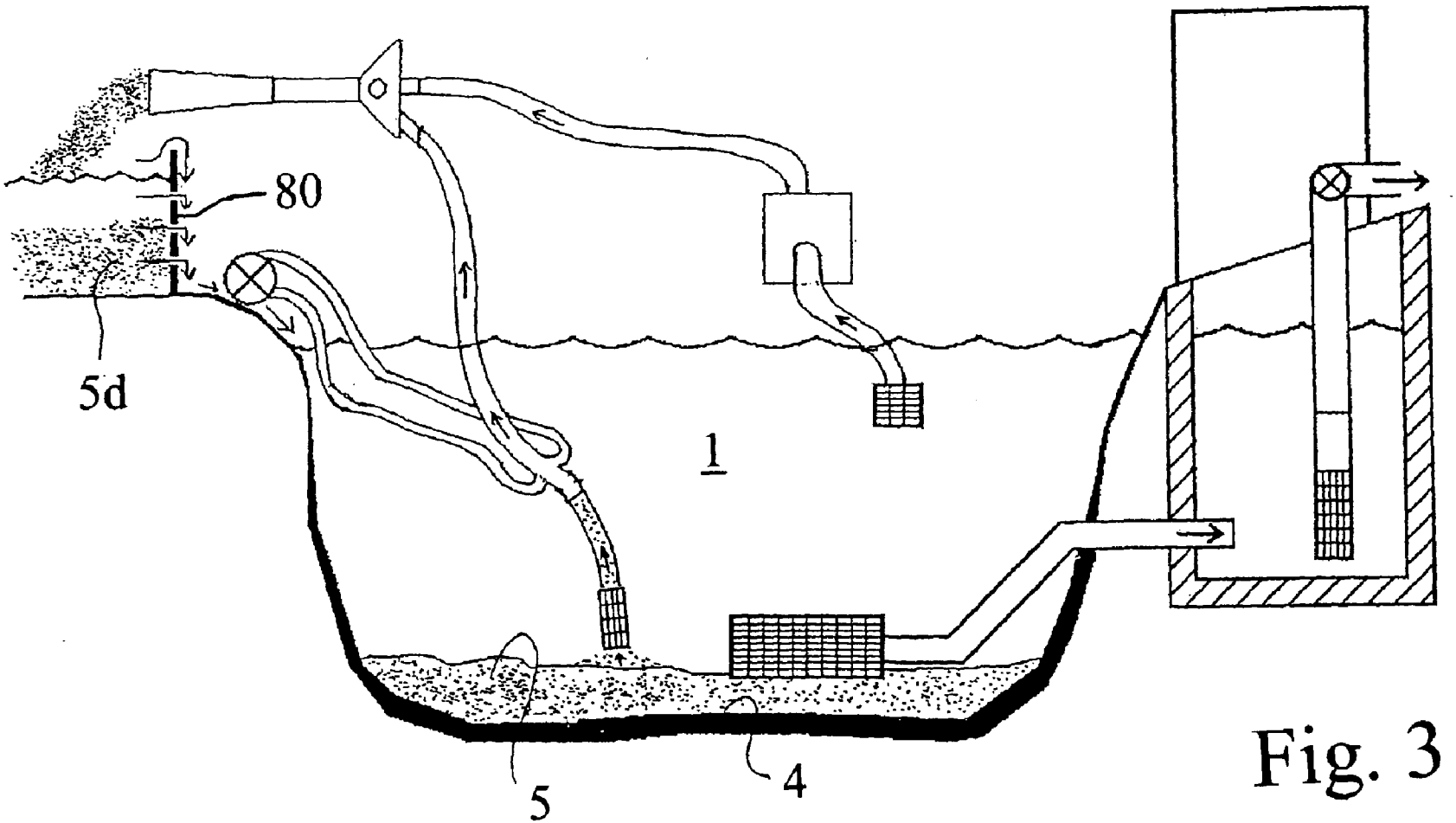
FIG. 3 shows the water hazard of FIGS. 1 and 2 with the invention in place wherein approximately half of the sand, silt, detritus and debris has been removed from the vicinity of the water inlet.

FIG. 3 illustrates a continuation of the process wherein the detritus and debris 5 remaining on the floor 4 of reservoir 1 has been reduced while the amount of debris 5*d* collecting behind permeable dam 80 has accordingly increased as it settles out from the water stream passing through eductor 40.

Figure 4:
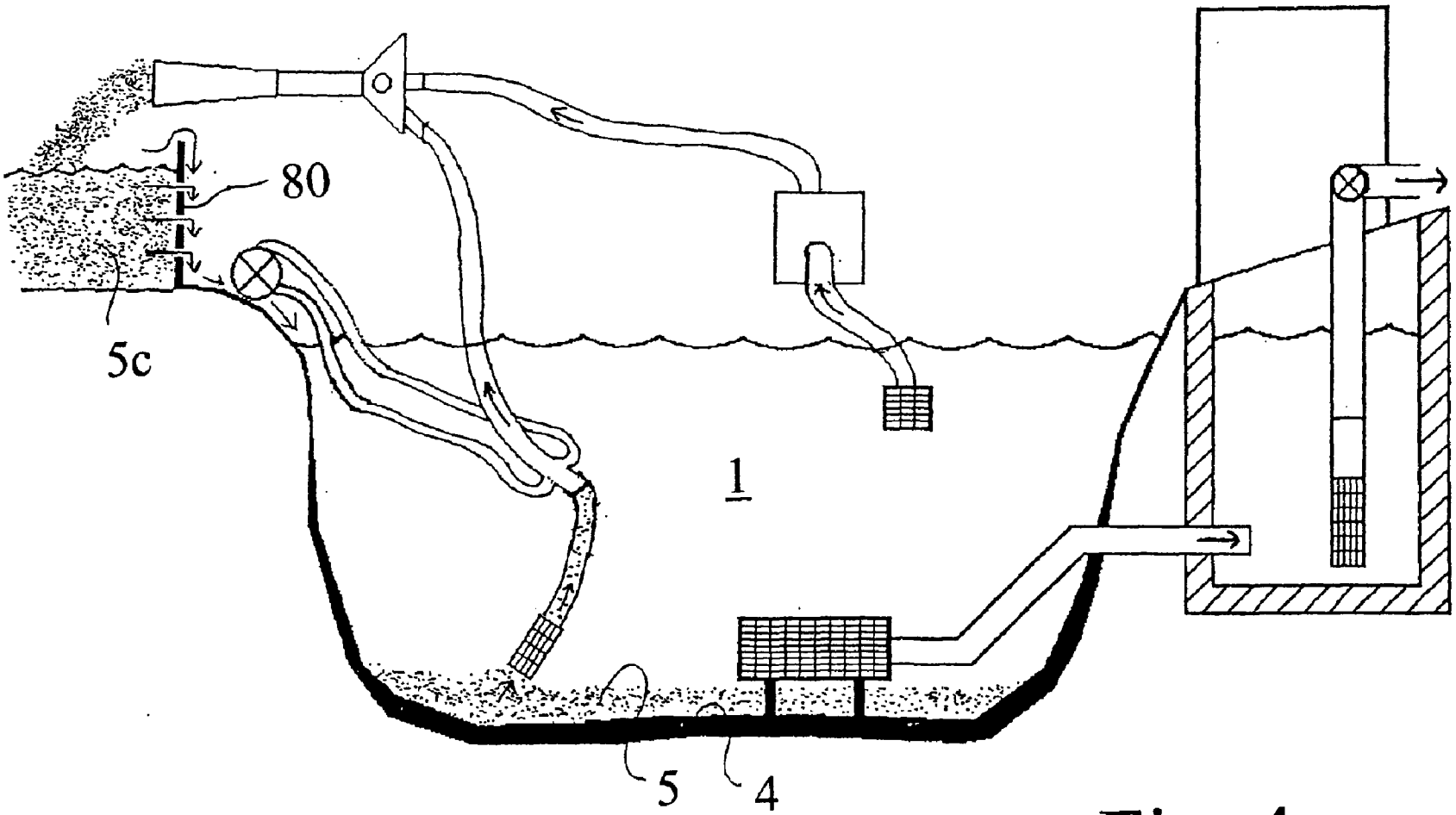
FIG. 4 shows a continuation of the process of removing the detritus from the reservoir illustrated in FIGS. 1–3 and showing that the debris in the bottom of the reservoir has nearly been completely removed.

FIG. 4 illustrates a continuation of the process wherein nearly all of the debris 5 has been removed from the floor 4 of reservoir 1 and is being collected as detritus and debris 5*d* within permeable dam structure 80.

Figure 5:
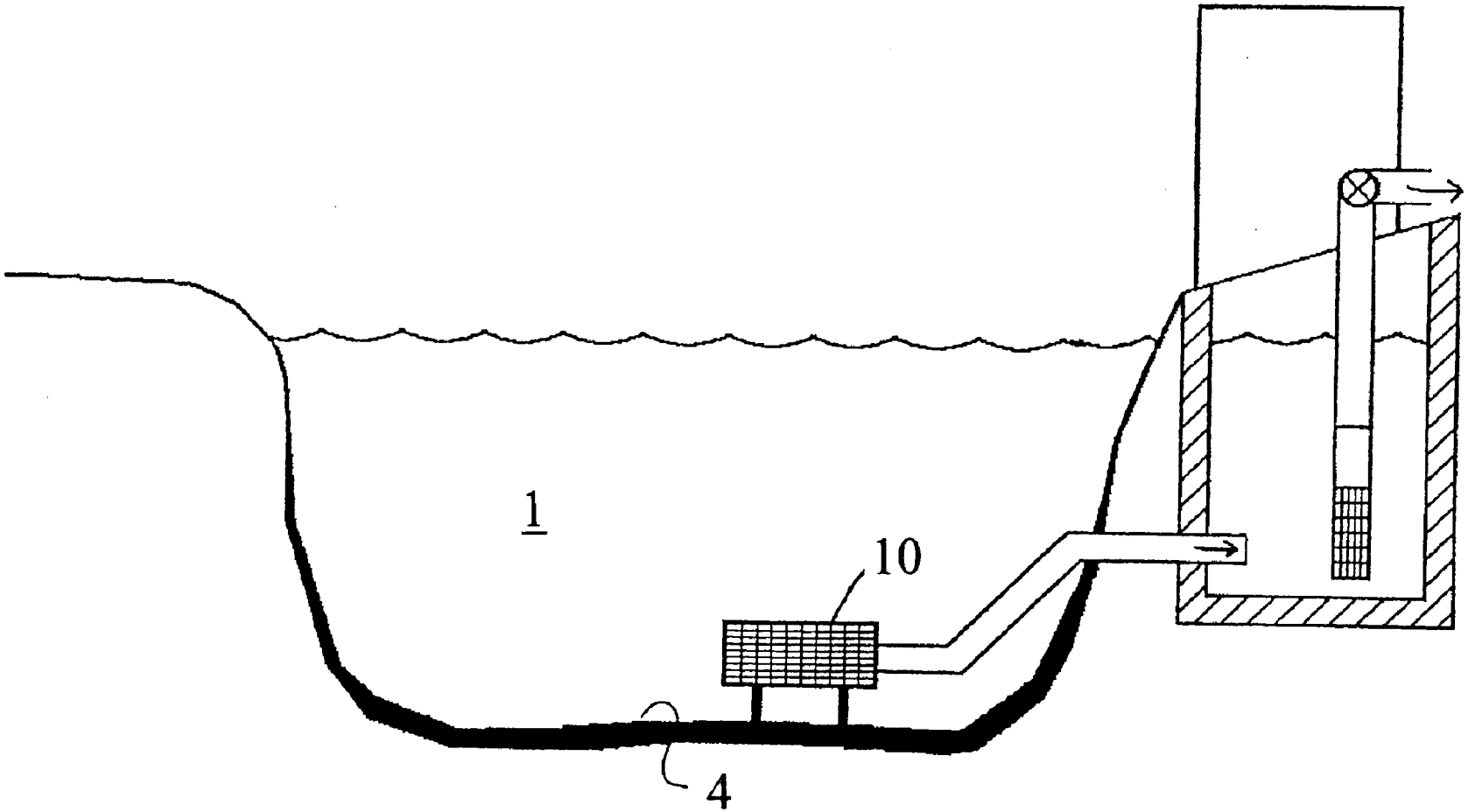
FIG. 5 illustrates the reservoir of FIG. 1 after the equipment of the present invention has been removed and showing the sand, silt, detritus and other debris having been removed from the reservoir.

FIG. 5 illustrates reservoir 1 after the present invention has been utilized to remove the detritus and debris from the floor or bottom of the reservoir 1. The equipment has been removed from the reservoir 1 and the temporary, permeable dam 80 has been removed along with the debris temporarily stored within the dam structure 80. As a practical matter, many primary reservoirs are too large to have debris removed from the entire floor or bottom of the reservoir. In those situations, the debris, including sand, silt, detritus, golf balls, rocks, etc., are removed a prescribed distance away from the inlet 10. For example, if the debris is removed around most inlets for a radius of approximately 12 to 15 feet, the inlet 10 will remain free of debris for approximately six months.

Although the wet well 20 illustrated in FIGS. 1–5 is shown without any debris or detritus in it, any detritus or debris collecting on the floor 23 of wet well 20 is removed in the same fashion as removing the debris from the floor of reservoir 1. A diver enters wet well 20 and moves the vacuum nozzle intake 61 to and fro across the surface of debris collected in the base of wet well 20 until it is removed. The diver also uses the vacuum nozzle inlet 61 to clean the grate on inlet 10 as well as grate or screen 29 on the inlet to irrigation pump 26.

Figure 6A:
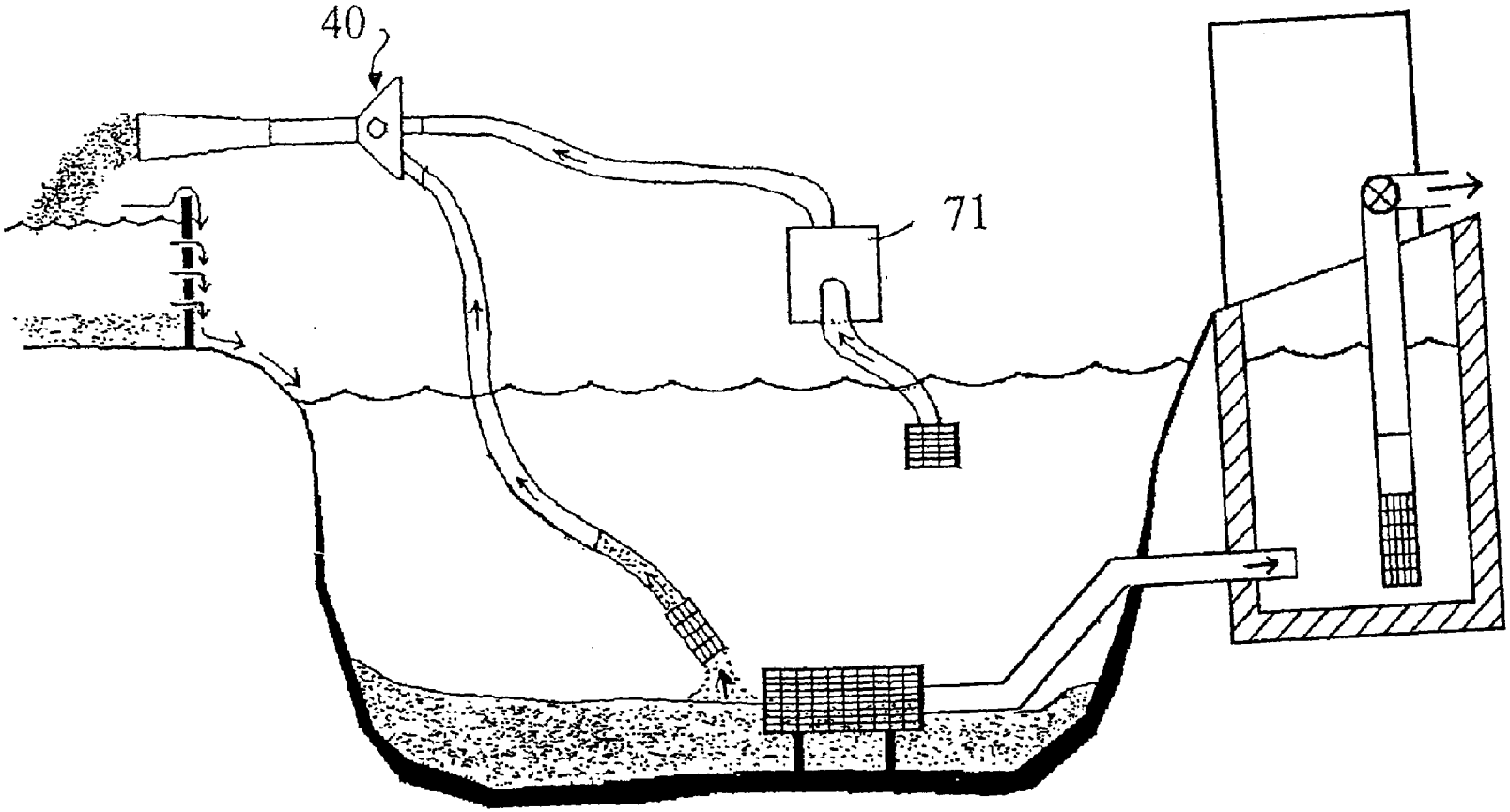
FIG. 6A is a schematic illustration showing an alternate form of the invention in the process of removing sand, silt and debris from the reservoir illustrated in FIG. 1.

FIG. 6A illustrates an alternate embodiment of the invention utilizing the same reference numerals shown in FIGS. 1–5. The embodiment illustrated in FIG. 6A does not include the optional injector pump 90, rather the embodiment illustrated in FIG. 6A relies strictly on the vacuum generated within eductor 40 by pump 71.

Figure 6B:
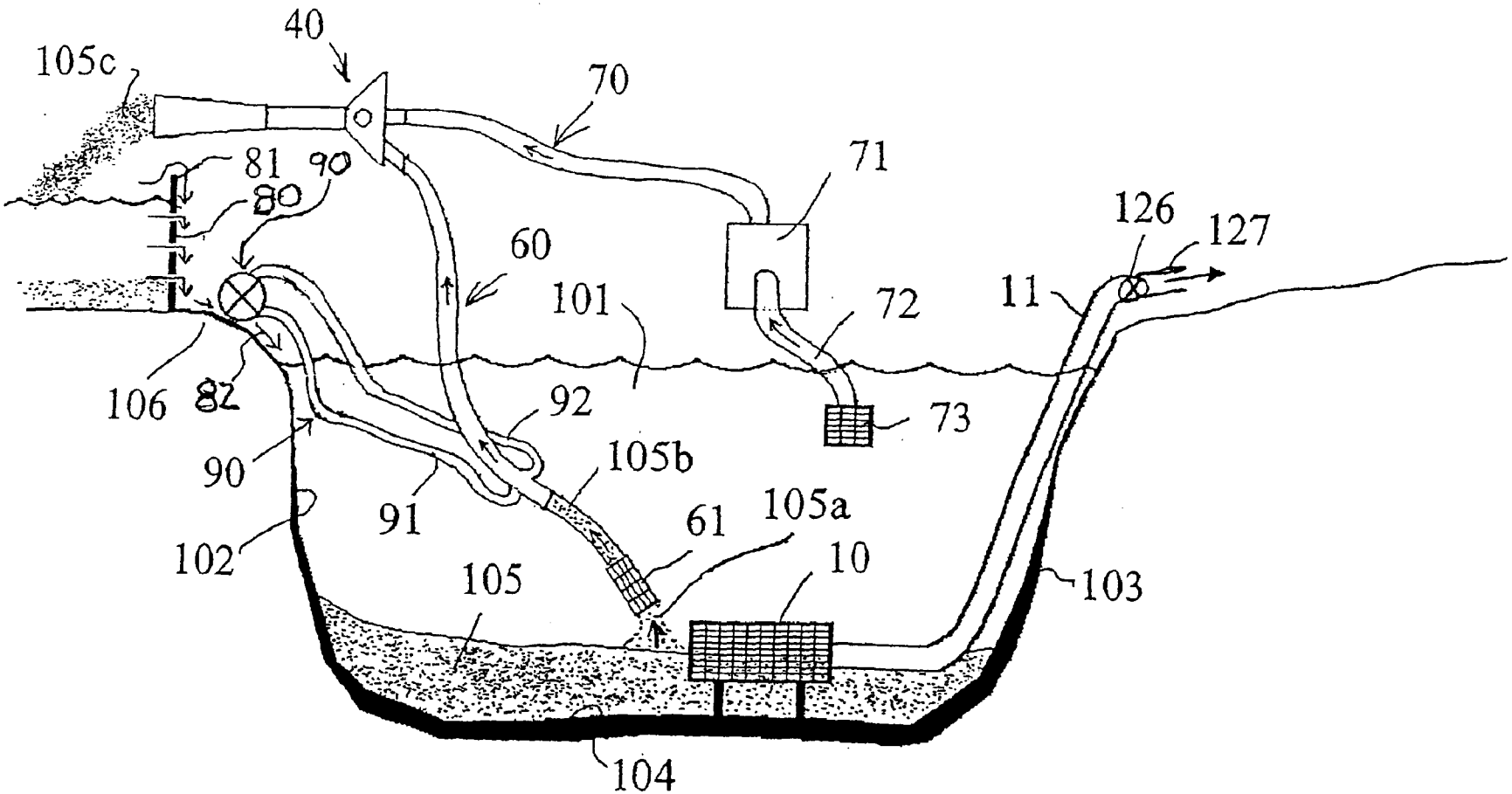
FIG. 6B is a schematic illustration showing the apparatus of FIG. 2 being used in a decorative pool or fountain.

FIG. 6B illustrates the apparatus of FIGS. 2–4 being utilized to clean a reservoir 101 for a decorative pool, fountain or pond with a recirculating water system. The reference numbers for the apparatus are the same as in FIGS. 2–4. Reservoir 101 has side walls 102,103 and bottom 104. Recirculating pump 126 pumps water from reservoir 101 through outlet pipe 127. Water in outlet pipe 127 may be fed into a fountain, waterfall, or man-made river bed, for example, and without limitation. The present invention may be used to clean any water reservoir for a recirculating water system having a water inlet which tends to become fouled with detritus and debris over time.

Figure 7:
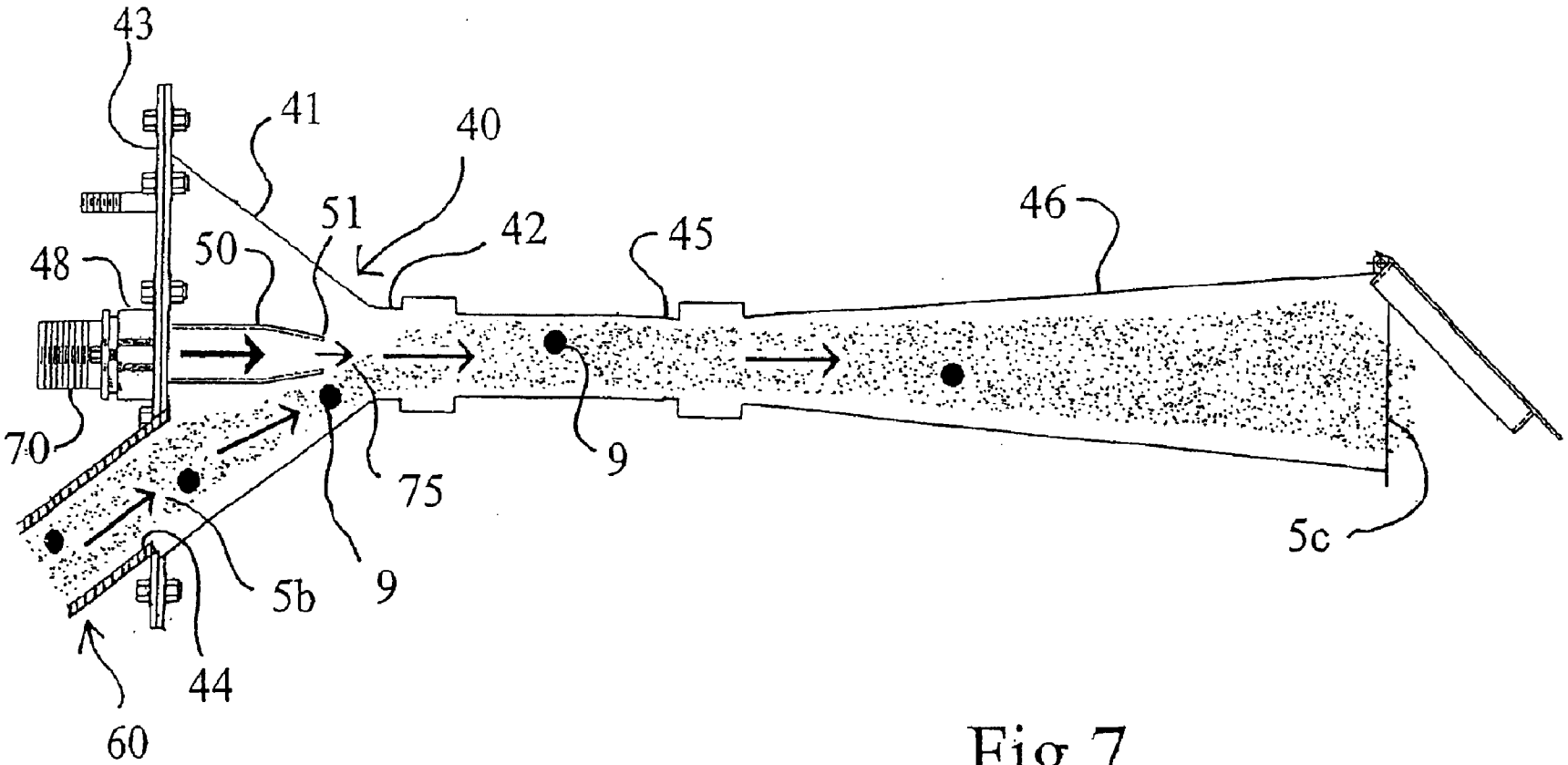
FIG. 7 is a side, elevational view, partially in section, showing the eductor assembly of the present invention.
Figure 28:
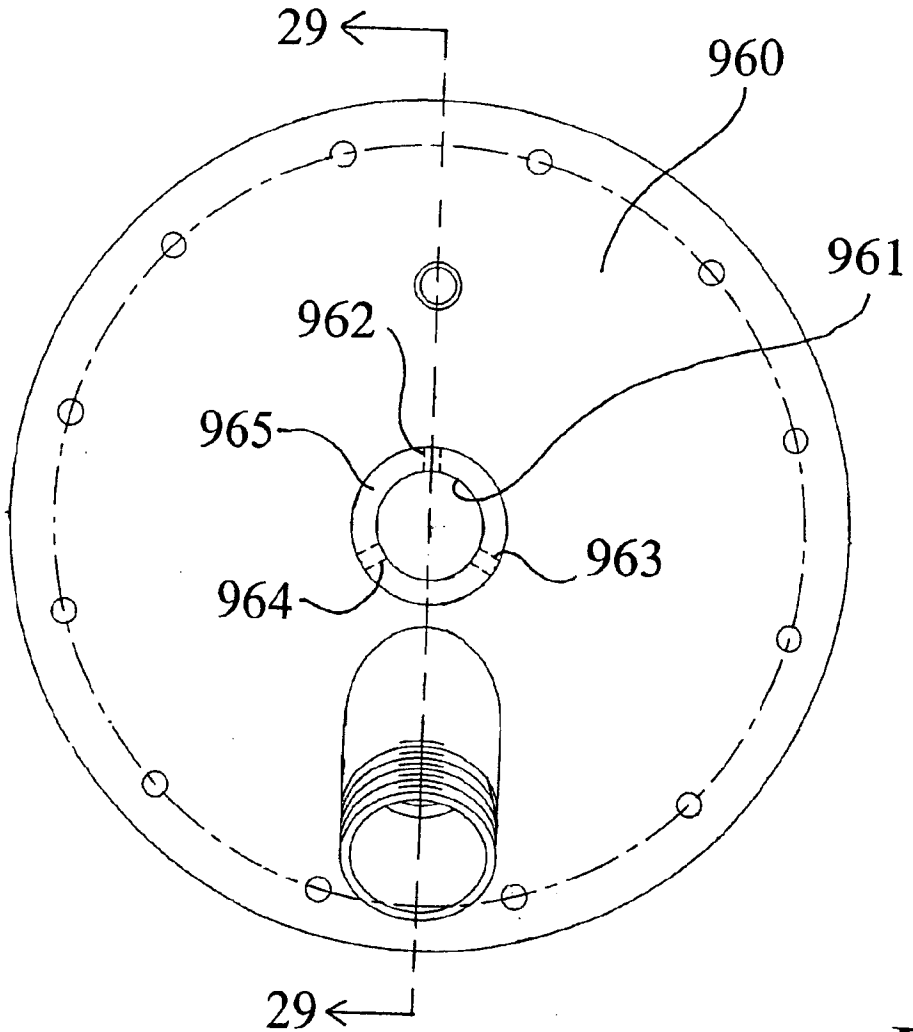
FIG. 28 is an elevational view of the cover for the mixing chamber or housing.
Figure 29:
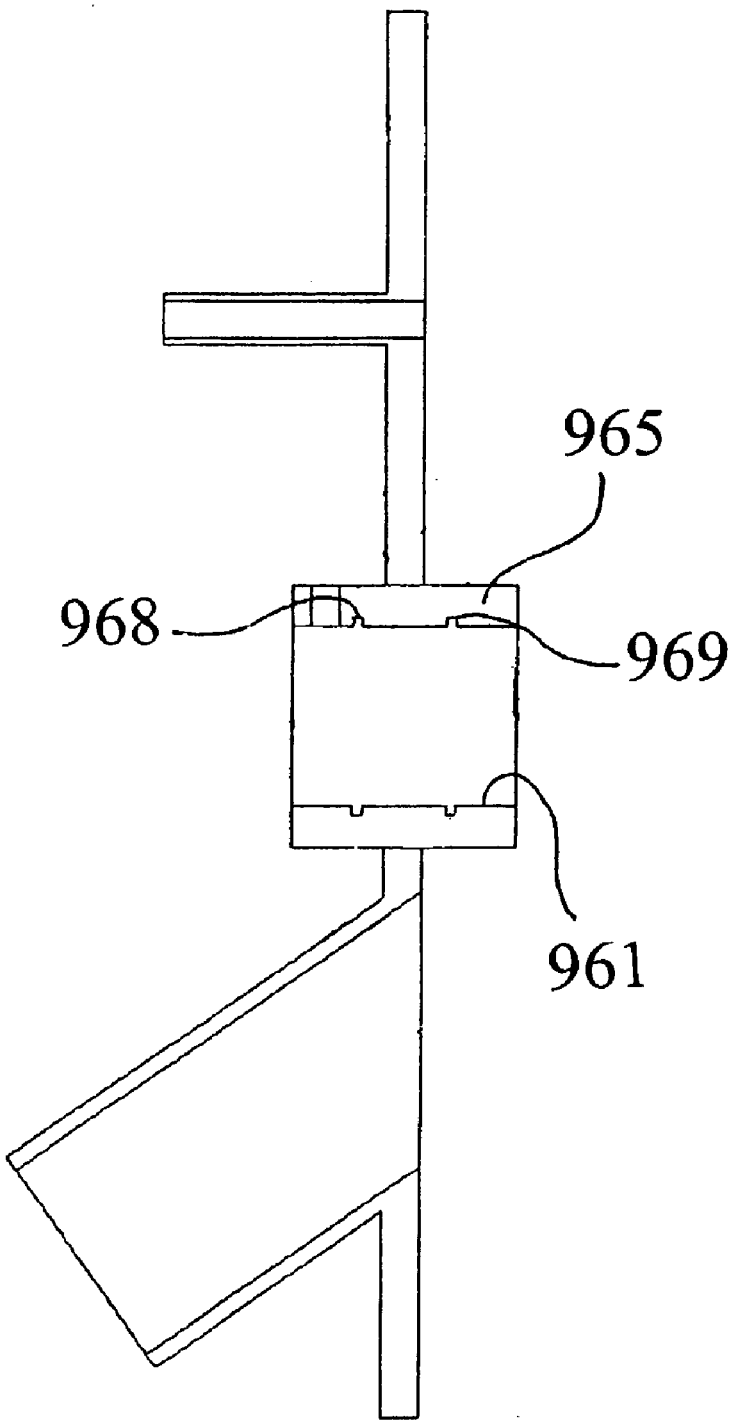
FIG. 29 is a section on the line 29—29 of FIG. 28.

FIG. 7 illustrates eductor 40 and is a partially broken away view to illustrate its internal operation. Eductor 40 includes a generally conical shaped housing or mixing chamber 41 having a truncated apex 42 which forms an eductor outlet. The housing or mixing chamber 41 is bolted to a cover 43 which is disc-shaped and has a circular periphery. Cover 43 includes a vacuum line inlet 44 which is connected to vacuum line 60. At the center of cover 43, a passageway is formed for slidably receiving and carrying nozzle 50. Nozzle 50 receives water pumped through pressure line 70 by pump 71 (see FIG. 2). Cover 43 supports and is connected to nozzle 50, as described in detail below (FIGS. 28–29). Nozzle 50 has a reduced diameter tip 51 having an internal diameter $d_1$ through which high pressure water is pumped by pump 71 as represented by arrows 75. The flow of water 75 through nozzle 51 generates a large vacuum which causes a large vacuum to be applied to vacuum line 60 which in turn sucks water and entrained debris 5*b* through vacuum line 60 and past nozzle 51. The conical body 41 of eductor 40 forms a mixing chamber in which debris 5*b* is mixed with high pressure water 75 and forced through the body section 45 of eductor 40 and through an eductor discharge 46 which is tapered and becomes larger at its distal end 47. Debris 5*c* is shown schematically in FIG. 7 being discharged from eductor 40. Also, illustrated schematically in FIG. 7 are several golf balls 9 which have been picked up by vacuum line 60 along with debris 5*b*. Golf ball 9*a* is shown passing through the "choke-point," i.e., where the nozzle tip 51 comes closest to the wall of conical body 41. A priming flap 49 is pivotally carried at the distal end 47 of eductor discharge tube 46. The priming flap 94 has two positions; a closed position (FIGS. 9 and 10) in which it seals against the distal end 47 of eductor discharge tube 46 to prime eductor 40; and an open position (FIG. 7) in which it allows water with entrained detritus and debris to flow freely out of discharge tube 46.

Figure 8A:
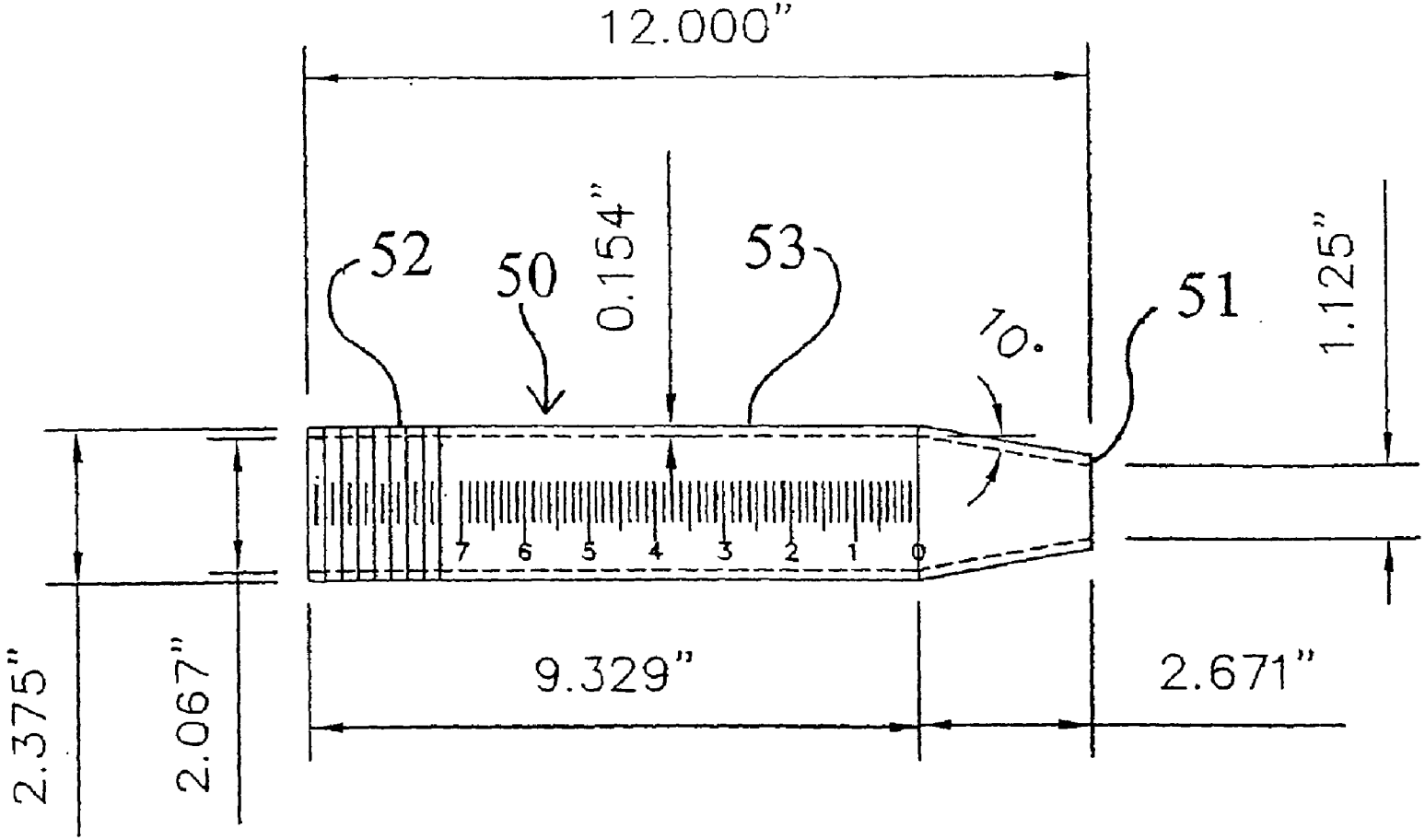
FIG. 8A is an elevational view of an eductor nozzle used in the present invention.

FIG. 8A is an elevational view of an aluminum nozzle 50, including dimensions all of which are incorporated herein by reference. Nozzle 50 has a tubular shaped body 53. The body 53 is slidably carried by the cover 43 for the mixing chamber, as described with FIGS. 28–29 below. Nozzle tip 51 has an inner diameter of 1.125 inch and it is tapered at a 10° angle relative to nozzle body 53. Nozzle body 53 is constructed of 2 inch aluminum pipe.

Figure 8B:
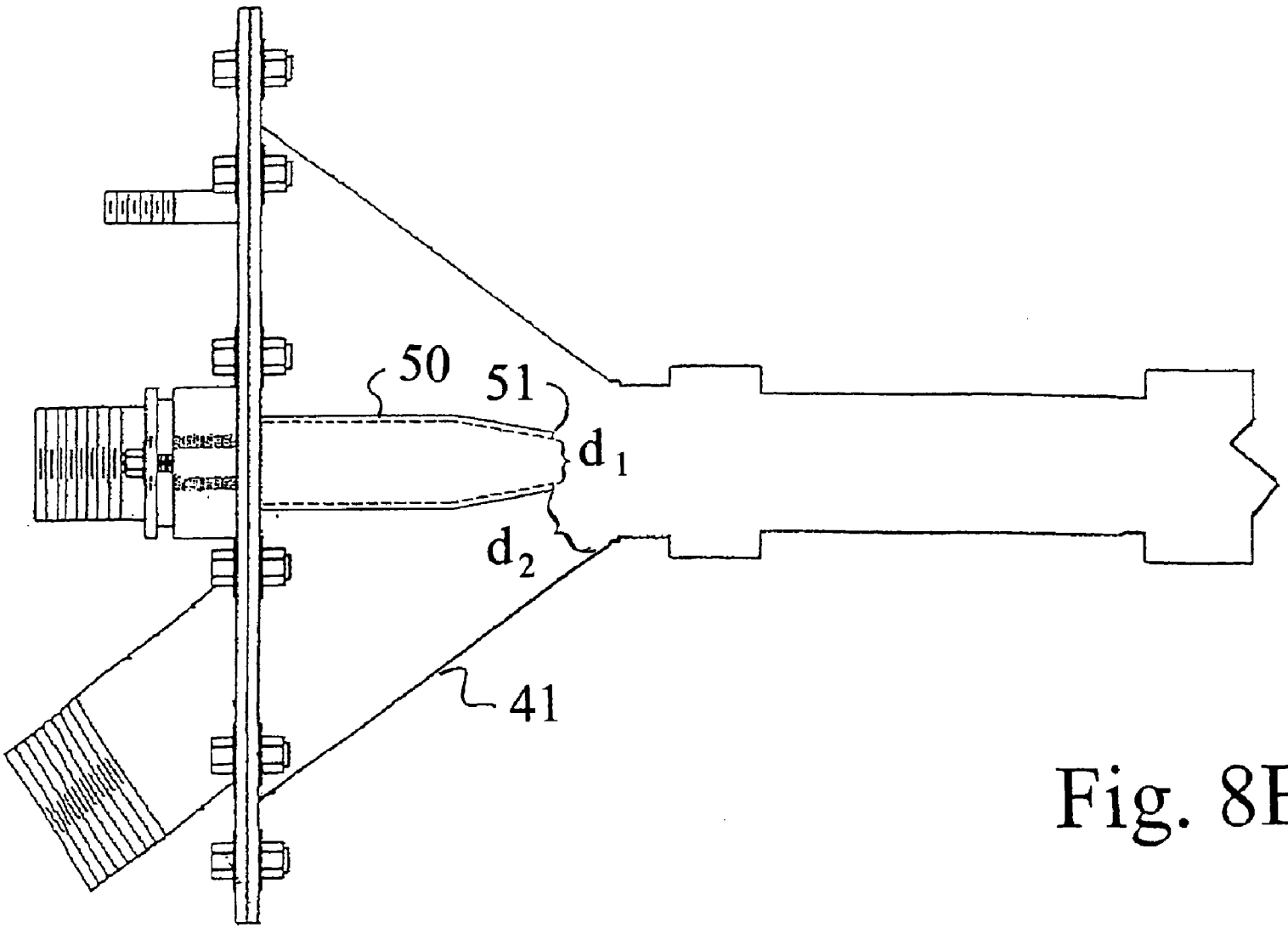
FIGS. 8B–8C are schematics showing adjustability of the nozzle.
Figure 8C:
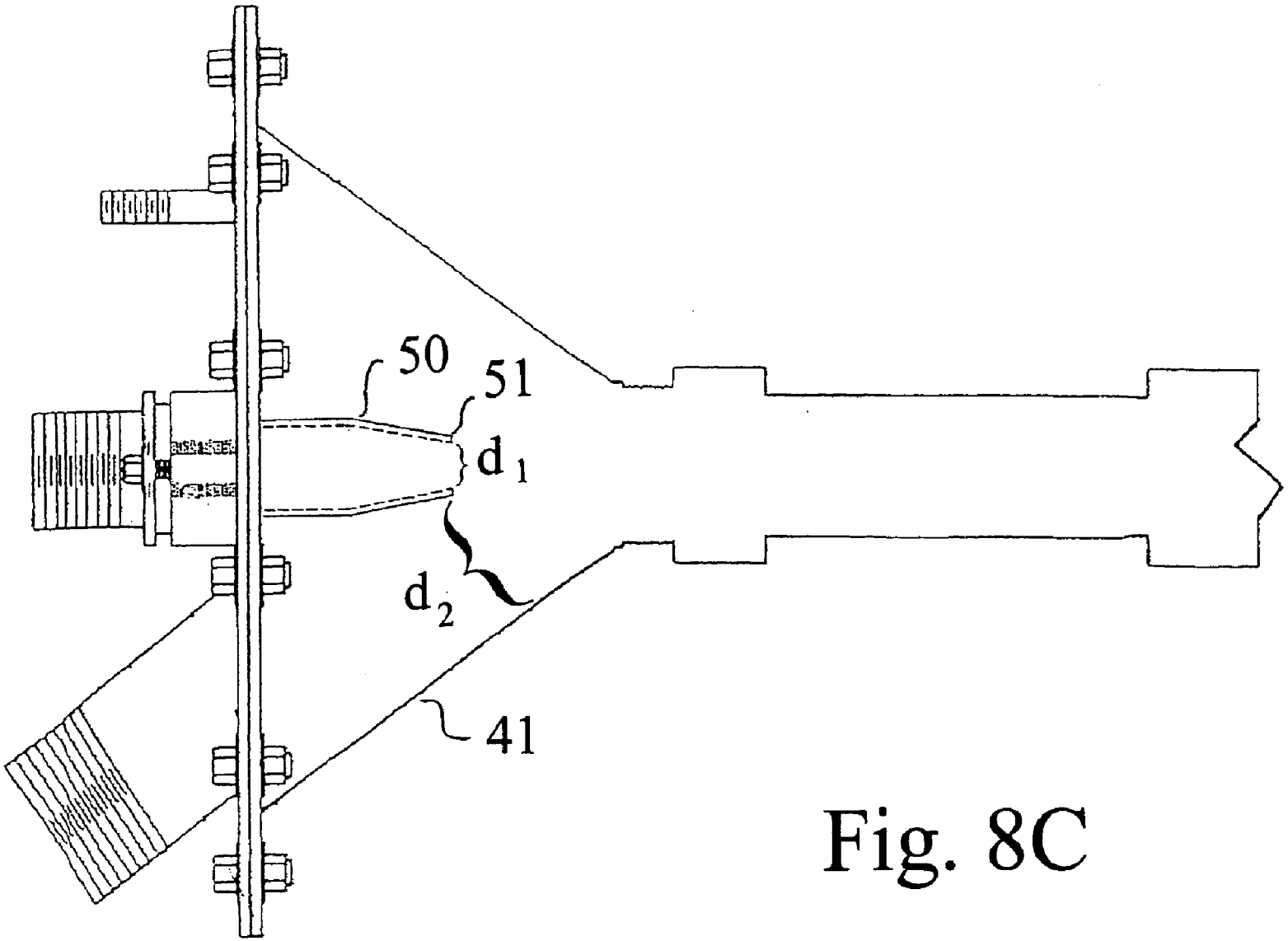

As shown in FIGS. 8B–8C, nozzle 50 may be adjustably positioned by sliding it relative to cover 43 in order to vary the "choke-point" distance $d_2$ between nozzle tip 51 and the side wall of mixing chamber or conical housing 41. The "choke-point" distance $d_2$ represents the smallest opening through which the detritus and debris must pass. The smaller the choke-point distance (FIG. 8B); the more easily the eductor becomes clogged; the larger the choke-point distance (FIG. 8C), the less vacuum is created in line 60. In the preferred embodiment, the "choke-point" distance $d_2$ ranges between 1.50 and 2.25 inches.

Figure 9:
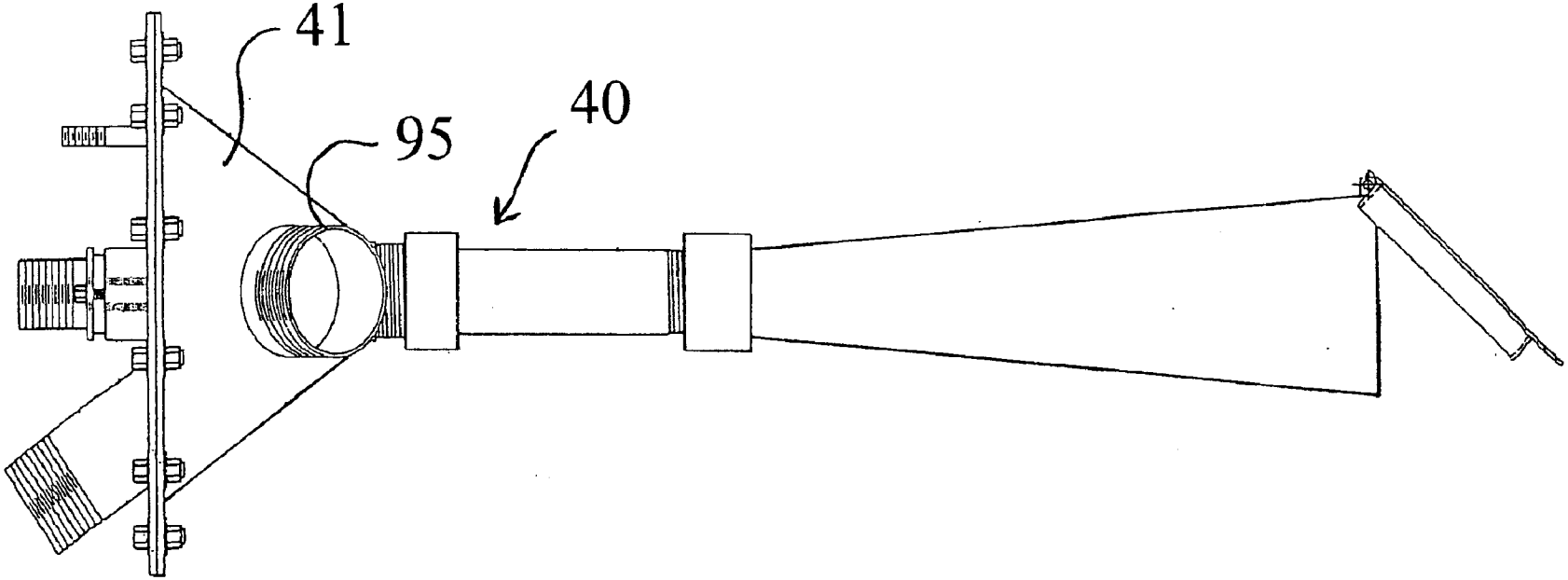
FIG. 9 is a side, elevational view of the eductor assembly illustrating a cutout used to access the mixing chamber if the mixing chamber becomes clogged with debris.

FIG. 9 is a side elevational view of eductor 40 which illustrates a four inch diameter clean out line 95 attached to the body 41 of eductor 40. The clean out 95 provides access to the interior of body 41 in the event that rocks or sludge or other debris form a blockage inside eductor 40. Clean out 95 is threaded to receive a cap, not shown, in FIG. 9. Clean out 95 is four inches in diameter and is welded to conical body 41; its diameter is large enough to allow a user to insert a hand or tools therein to clear any clog within eductor 40.

Figure 10:
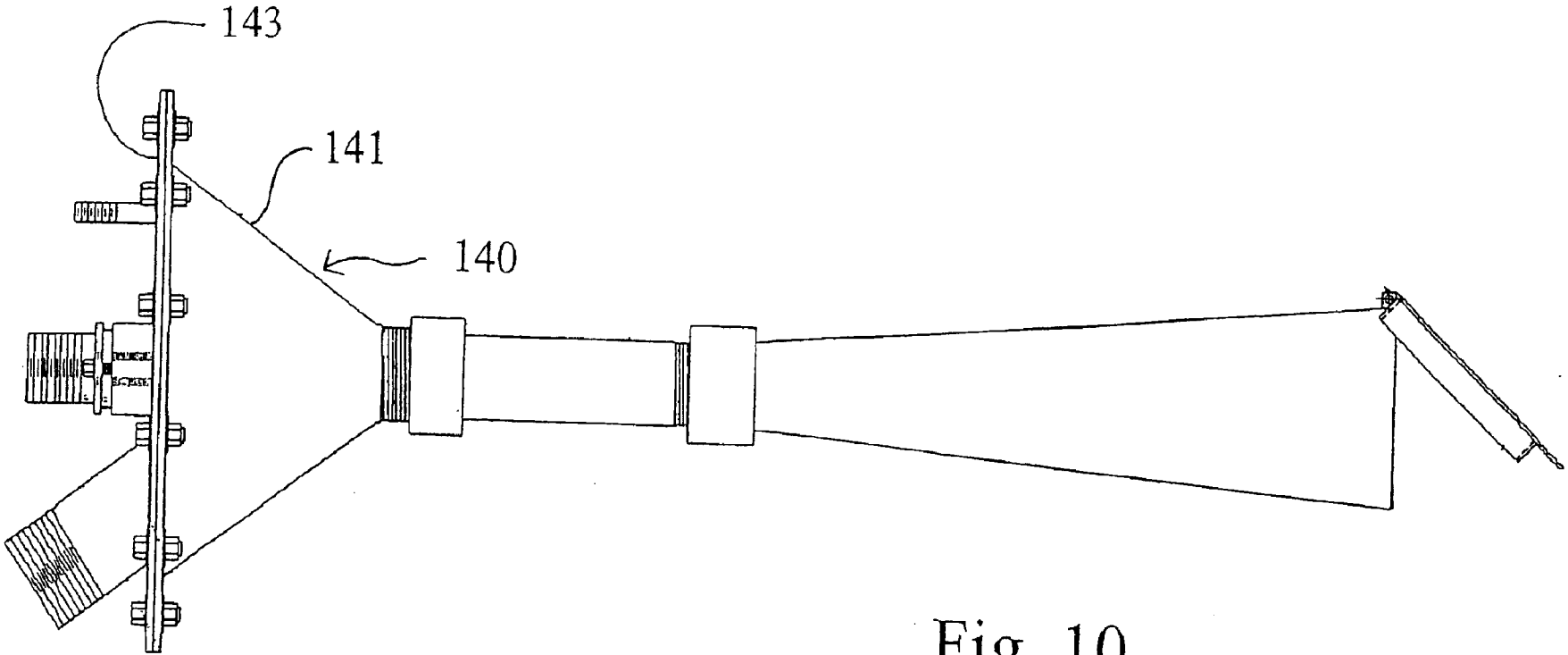
FIG. 10 is a side, elevational view of an alternate form of the eductor assembly wherein a cutout or clean out is not utilized.

FIG. 10 illustrates an alternate, but less preferred, eductor 140 which is identical to that illustrated in FIGS. 7–9, but which does not include clean out 95. Eductor 140 as illustrated in FIG. 10 will operate but, if it becomes clogged, clearing the clog is much more difficult, typically requiring removal of cover 143 from body 141.

The specific components which are presently utilized in the preferred model of the portable system illustrated in FIGS. 2–4 will now be described.

The pump 71 is used to drive the eductor is a Gorman-Rupp self-priming centrifugal pump. The Model is 13A-GX 390. The pump, itself, is driven by a 13 hp Honda engine. The pump will accept 1.5 inch spherical solids and utilizes a 3 inch diameter intake and 3 inch diameter exhaust line. I have found that the pump operating at 30–40 psi with a maximum of a 10 feet vertical lift will pump a maximum of approximately 350 gpm. The pump is mounted on a tubular frame with two tires and the pump assembly with frame weighs approximately 250 pounds. The pump assembly is capable of being rolled around by a single individual. The pump is lifted onto and off of the lightweight pickup truck by a lift gate mounted on the truck, itself. The intake line has a length of between 5 and 30 feet using a 3 inch diameter line. The exhaust line may extend between 10 feet and 60 feet with a 3 inch diameter. The pump is self-priming up to as much as 25 feet of lift.

Another piece of equipment, not shown in FIGS. 2–4, is the necessary equipment to pump air to the underwater diver manipulating the end of vacuum hose 60. These devices are referred to in the trade as a "Hookah." The air pump, itself, or "Hookah," is a Gast Model 71R642P163D500X and is driven by a Honda Model EG-2500X generator. The "Hookah" assembly is loaded and unloaded by a single individual and may be moved around by a single individual.

The injector pump, shown as reference 90 in FIGS. 2–4, is a Keene Engineering Model P289H centrifugal pump, which is not self-priming. The pump is driven by a 9 hp Honda engine. The pump has a 2½ inch diameter intake and a 2 inch diameter exhaust line. This pump is easily handled and carried by a single individual.

The hoses used to connect to the eductor are supplied by Berg Nelson and utilize Dixon quick disconnect fittings for hoses. The eductor utilizes a 3 inch intake line (item 70 in FIGS. 2–4) and a 3 inch vacuum line (item 60 in FIGS. 2–4).

The truck utilized to transport this equipment is a GMC (or other make) ¾ or 1 ton heavy duty truck with a stake bed. The truck is fitted with a 1,000 pound Tommy (or other brand) lift gate. The truck is also equipped with single tires on the rear axle.

The materials utilized to construct the permeable dam are as follows. A sheet of impermeable polyethylene, either 4 mil or 6 mil thickness, is rolled out onto the ground from a 10 feet wide roll to form a waterproof base for the permeable dam structure. A plurality of 4 feet long steel stakes are driven through the polyethylene sheeting into the ground to form a perimeter, preferably four sides in rectangular shape for the permeable dam structure. Alternately, the permeable dam may be any enclosed shape, such as circular, oval or other shape. Also, if the permeable dam is formed on sloping ground, the dam may not be fully enclosed along its uppermost edge. Common perforated, orange colored safety fence with square, open mesh is strung between the steel stakes. A permeable fabric such as landscaper's fabric with fine mesh is then placed over the orange safety fence to create a three layered permeable dam structure. Water flows freely through the permeable landscaper's fabric, but the sand, detritus and debris are kept within the dam structure and collect on the impermeable polyethylene sheet forming the base of the dam structure. All of these materials are easily handled by one man.

The injector piping 91 is ¾ inch piping and is connected to the vacuum line at an angle of between 10 and 20 degrees. The injector preferably works at a pressure of approximately 30 psi. The injector contributes between 5 and 10% of the total water flow in the vacuum line.

The eductor 40 is approximately 4 feet long and weighs about 80 pounds. It can be transported and handled by one workman, but is preferably handled by two workmen. It is preferably mounted on a portable, tripod frame so that the eductor discharge chute sits horizontal and about 3 feet above ground.

The components of the preferred embodiment, described above and shown in FIGS. 2–4, are readily transported to the job site, put into position, operated for 4–6 hours and removed from the job site in a single day, by one or two workmen and a qualified diver.

Figure 11:
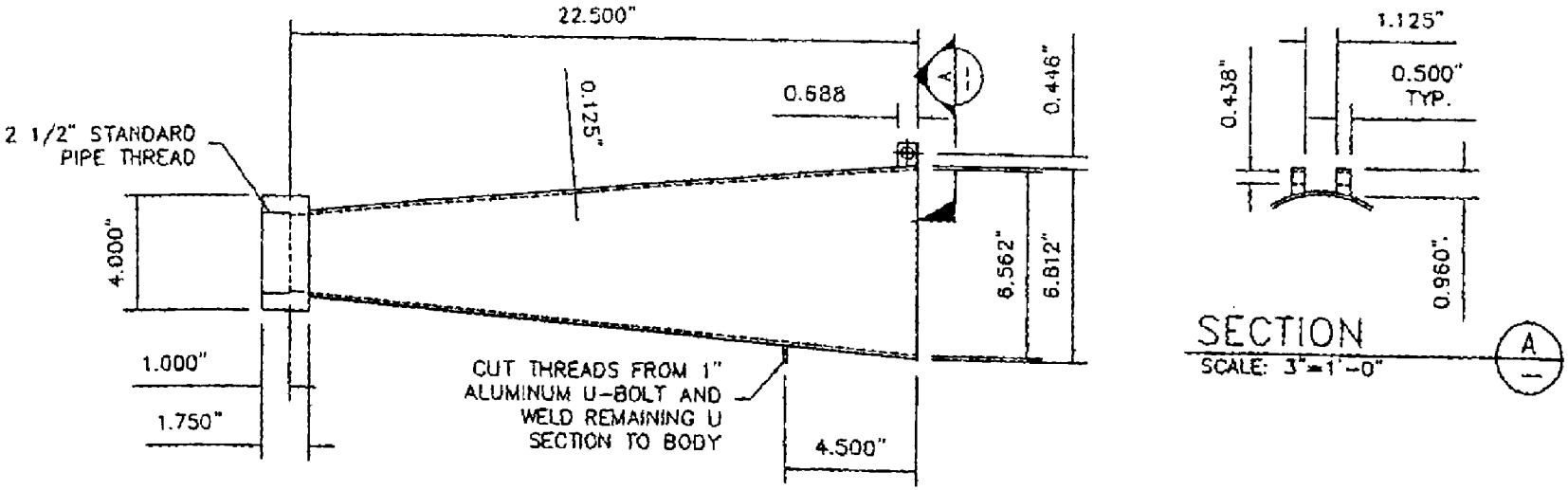
FIGS. 11–13 are scale drawings of components of eductor 40 shown in FIGS. 2–4.
Figure 12:
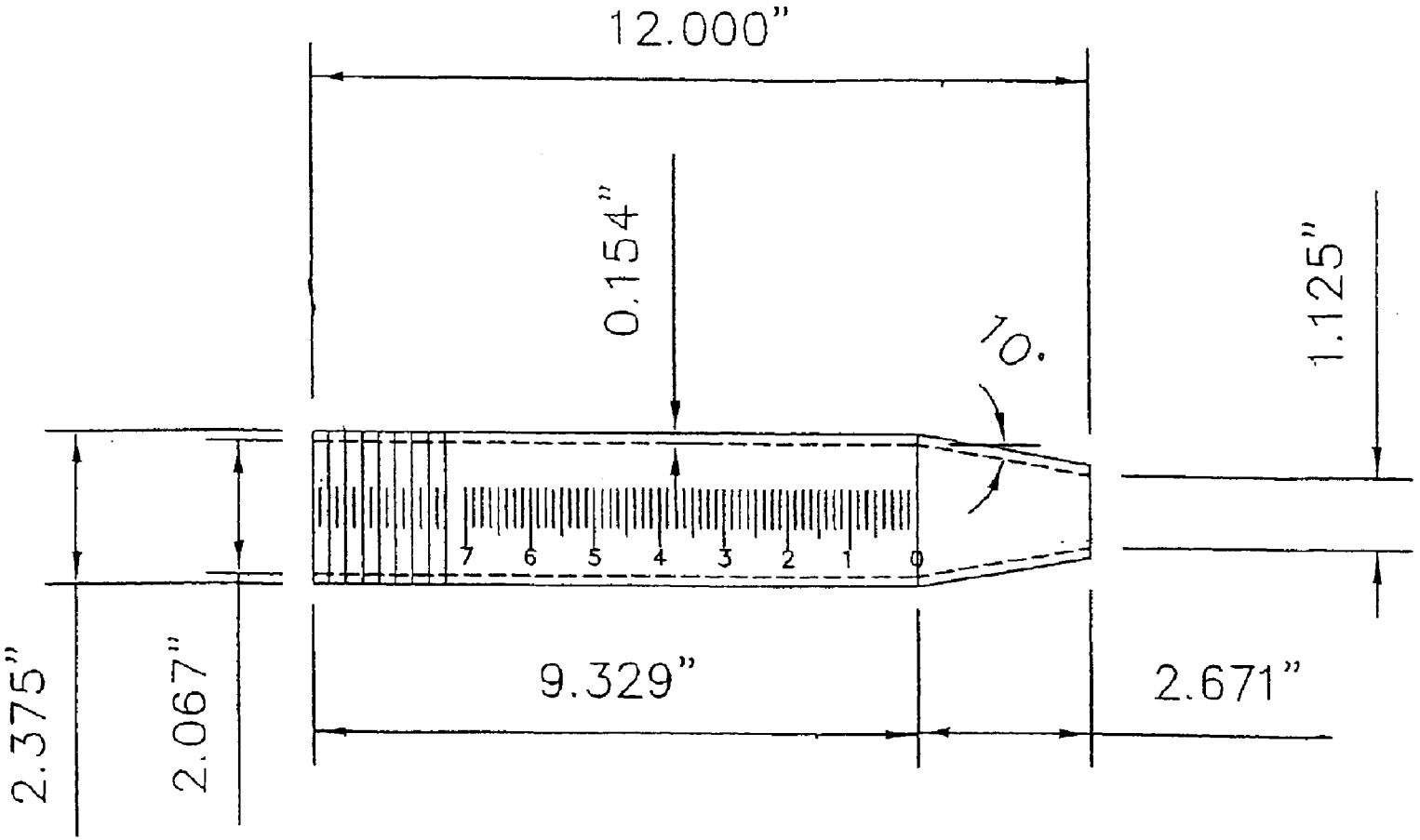
Figure 13:
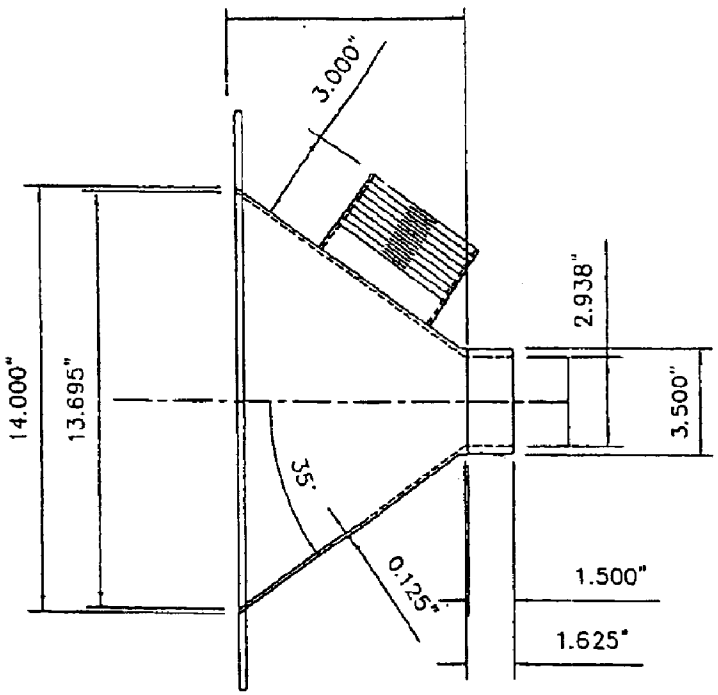
Figure 13:
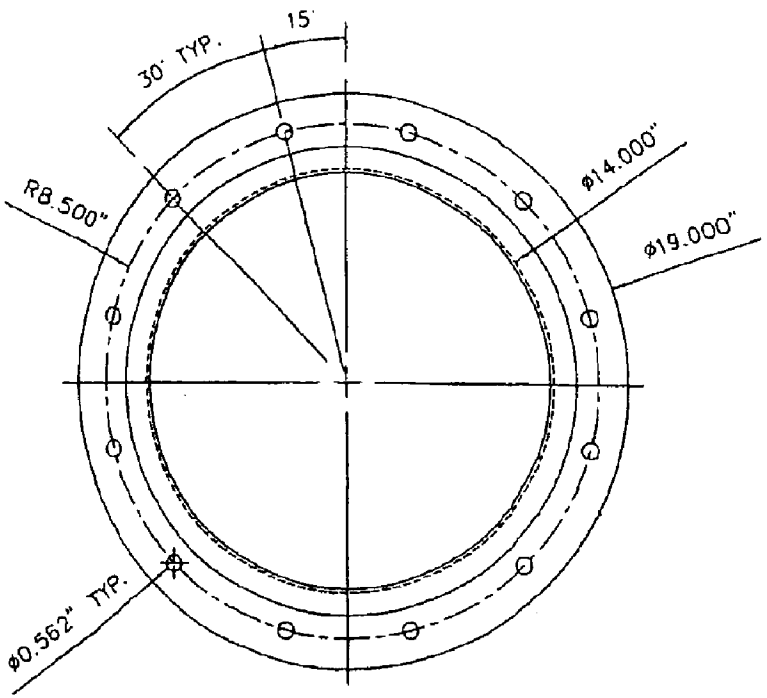

For the sake of completeness, FIGS. 11–13 are eductor part drawings, drawn to scale, which include important dimensions, incorporated herein by reference.

Alternate Embodiments of the Invention

The invention may be "scaled up" dimensionally for larger projects, wherein a larger eductor, larger vacuum line, larger high pressure line are utilized with larger pumps and motors.

Figure 14:
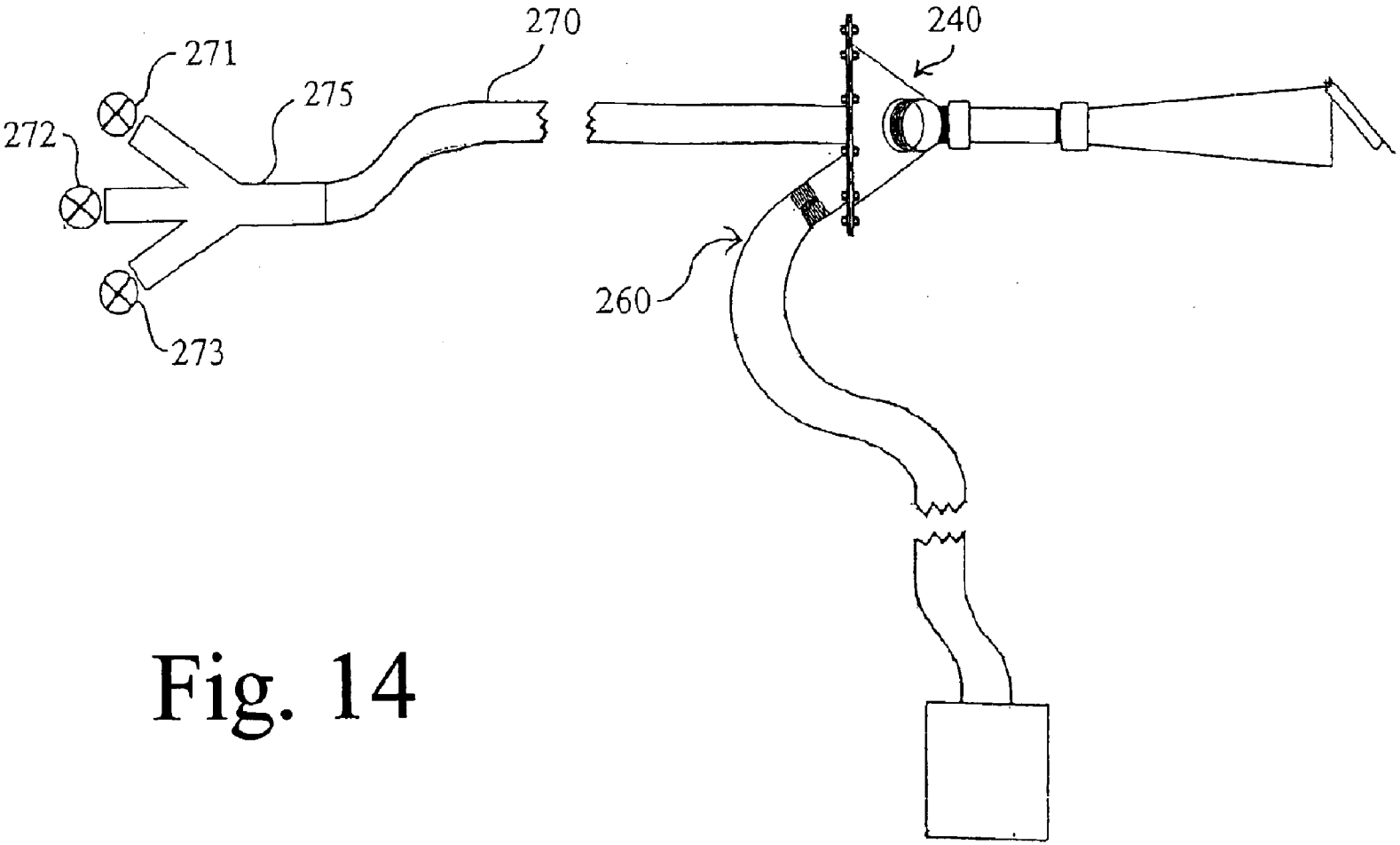
FIG. 14 is a schematic representation of an alternate embodiment of the invention wherein multiple pumps are used to drive a larger eductor with a larger, more powerful vacuum line.

It is also within the scope of the invention to combine two or more pumps to drive a larger eductor in order to utilize a larger diameter suction line. A larger diameter suction line is able to remove larger amounts of the detritus and debris and/or larger diameter pieces of detritus and debris. FIG. 14 illustrates conceptually how eductor 240 is constructed with a 6 inch diameter vacuum line 260. The high pressure water intake line 270 could be either 5 or 6 inches in diameter. Water is pumped into intake line 270 by three pumps 271,272 and 273 whose outlet lines are joined by three-way close fitting 275 which itself connects directly to intake pressure line 270. In this embodiment, the operational pressure of each pump in psi is equalized to achieve the maximum efficiency of eductor 240.

Figure 15:
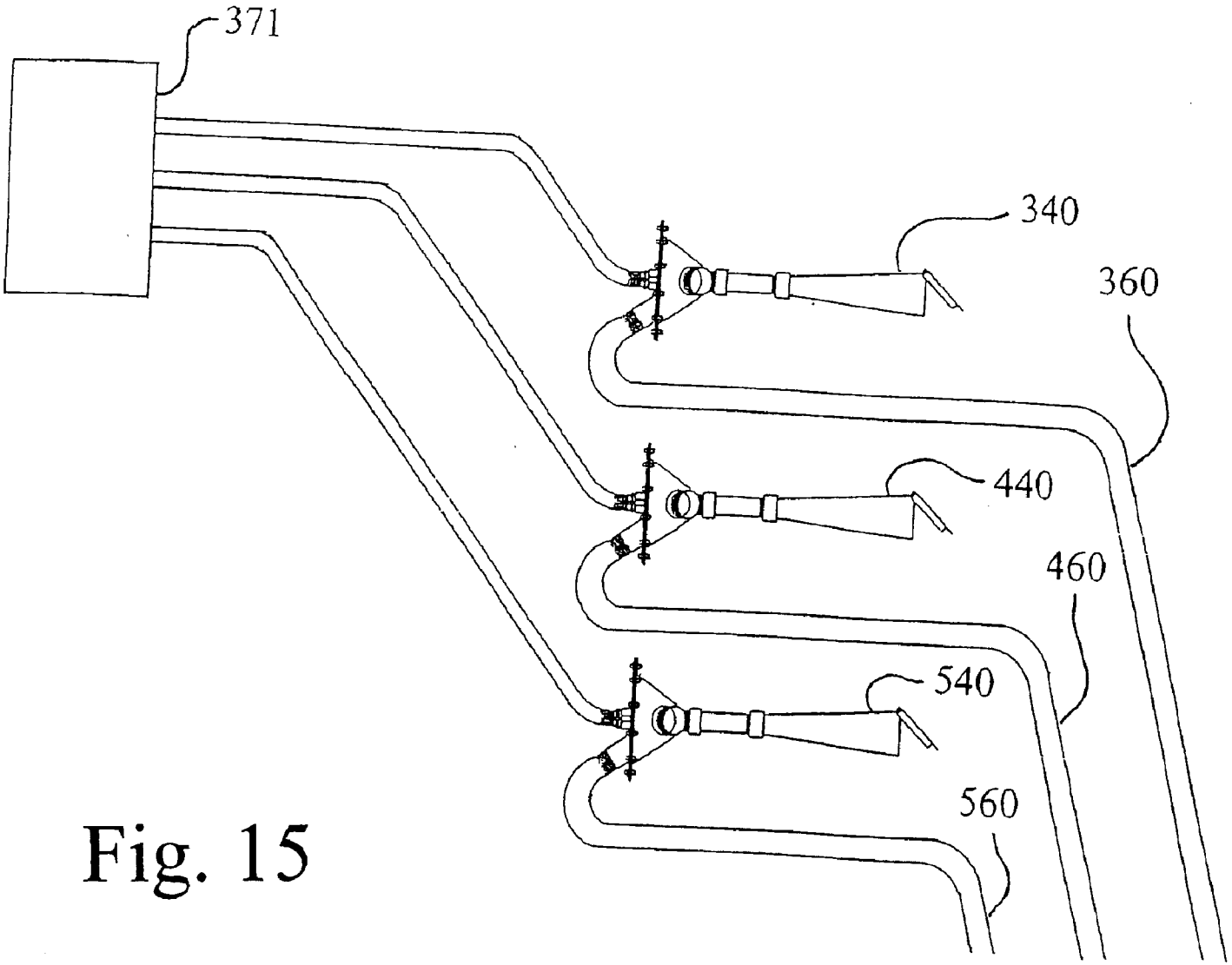
FIG. 15 is a schematic representation of an alternate embodiment of the invention wherein multiple eductors are driven by a single larger pump, each eductor vacuum line being handled by a different diver.

FIG. 15 illustrates another variation of the invention wherein one large pump could be utilized to feed several smaller eductors, wherein each eductor would be utilized by a separate diver. This variation would be significant where multiple divers are utilized in different areas at the same time. FIG. 15 illustrates pump 371 connected to eductors 340,440 and 540. The vacuum lines of the eductors 360, 460 and 560 are each handled by separate divers.

Figure 16:
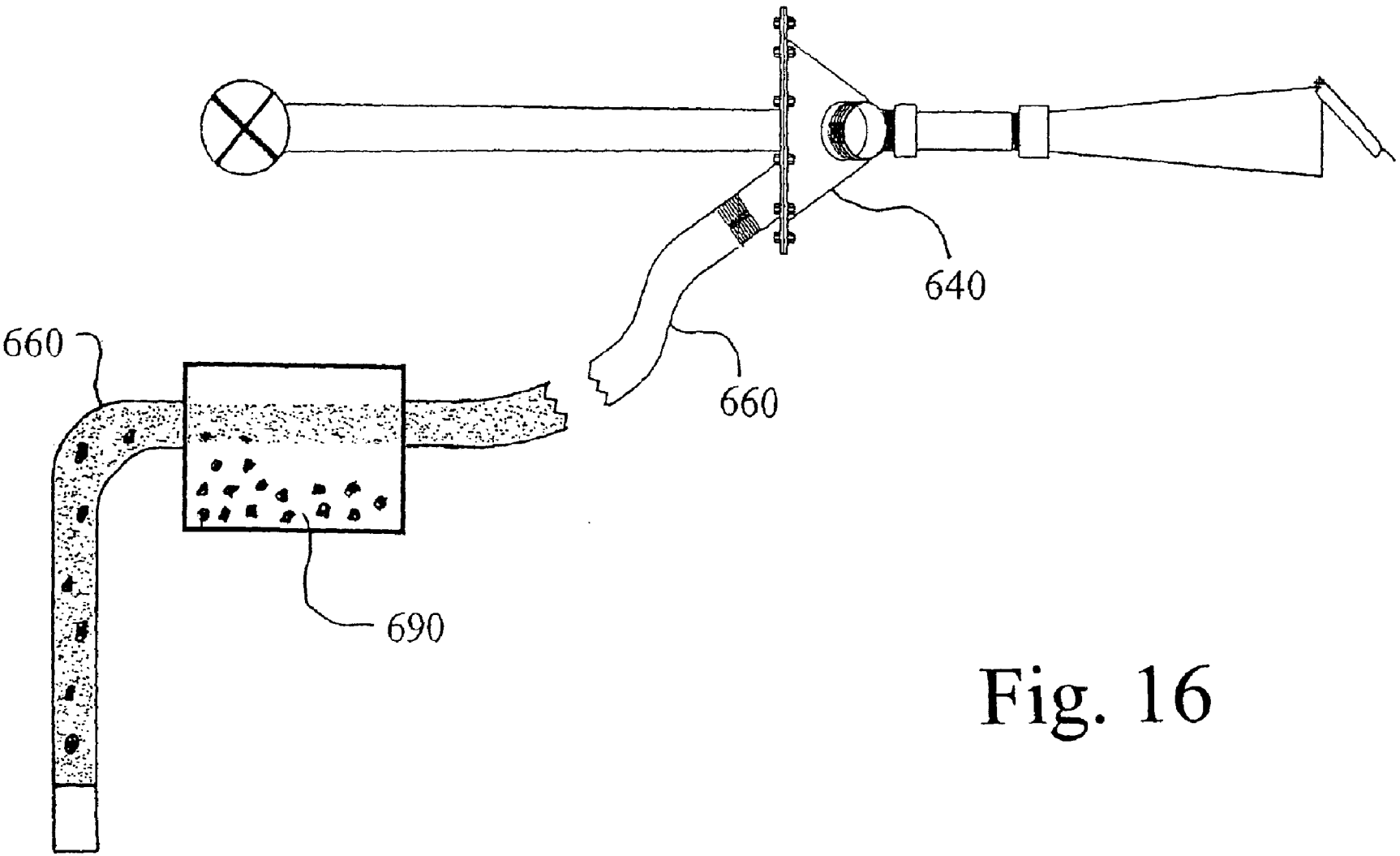
FIG. 16 is a schematic representation of an alternate embodiment of the invention wherein a collector box is used in the vacuum line to collect heavy particles such as gravel but which allows lighter particles to flow through to the eductor.

FIG. 16 illustrates another conceptual variation of the invention utilizing a collector box 690. The purpose of collector box 690 is that it is placed midway in the vacuum line 660 which feeds eductor 640. Collector box 690 allows heavier particles such as gravel and rocks to settle to the bottom of box 690 while simultaneously allowing lighter materials such as sand and fine sediment and detritus to flow through collection box to eductor 640. Collector box 690 periodically has the heavy and large particles emptied and separately disposed of.

Figure 17:
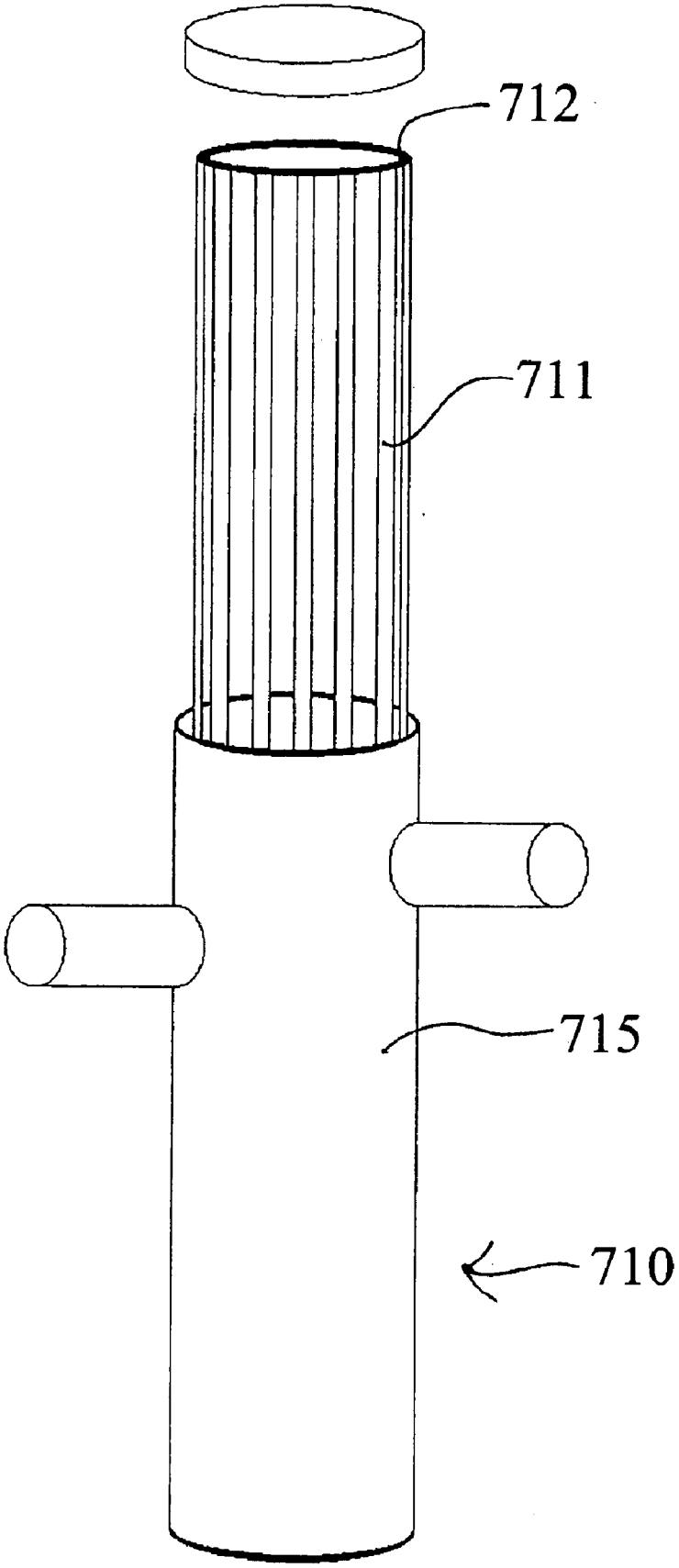
FIG. 17 is an exploded, perspective of an alternate collection box.

FIG. 17 illustrates a second collector box design, shown as 710. Box 710 has a vertically oriented, elongated and cylindrical body 715 and having a removable cap 712. A removable cage assembly 711, carried inside body 715, is designed to separate golf balls and other large particles which might otherwise clog the eductor from the debris. Cage 711 may be easily withdrawn and periodically emptied.

FIGS. 18–25 illustrate various alternate separation means for separating the debris from the water. These alternate separation means are examples and are not intended to limit the types of separation chambers or dams that may be utilized with the invention. Some of the alternate separation means are useful if toxic or hazardous waste material (which must be transported to an authorized disposal site) is present in the debris. Some of the alternate separation means are more efficient for separating algae or other undesirable plant life (hyacinth for example) from the water reservoir.

Figure 18:
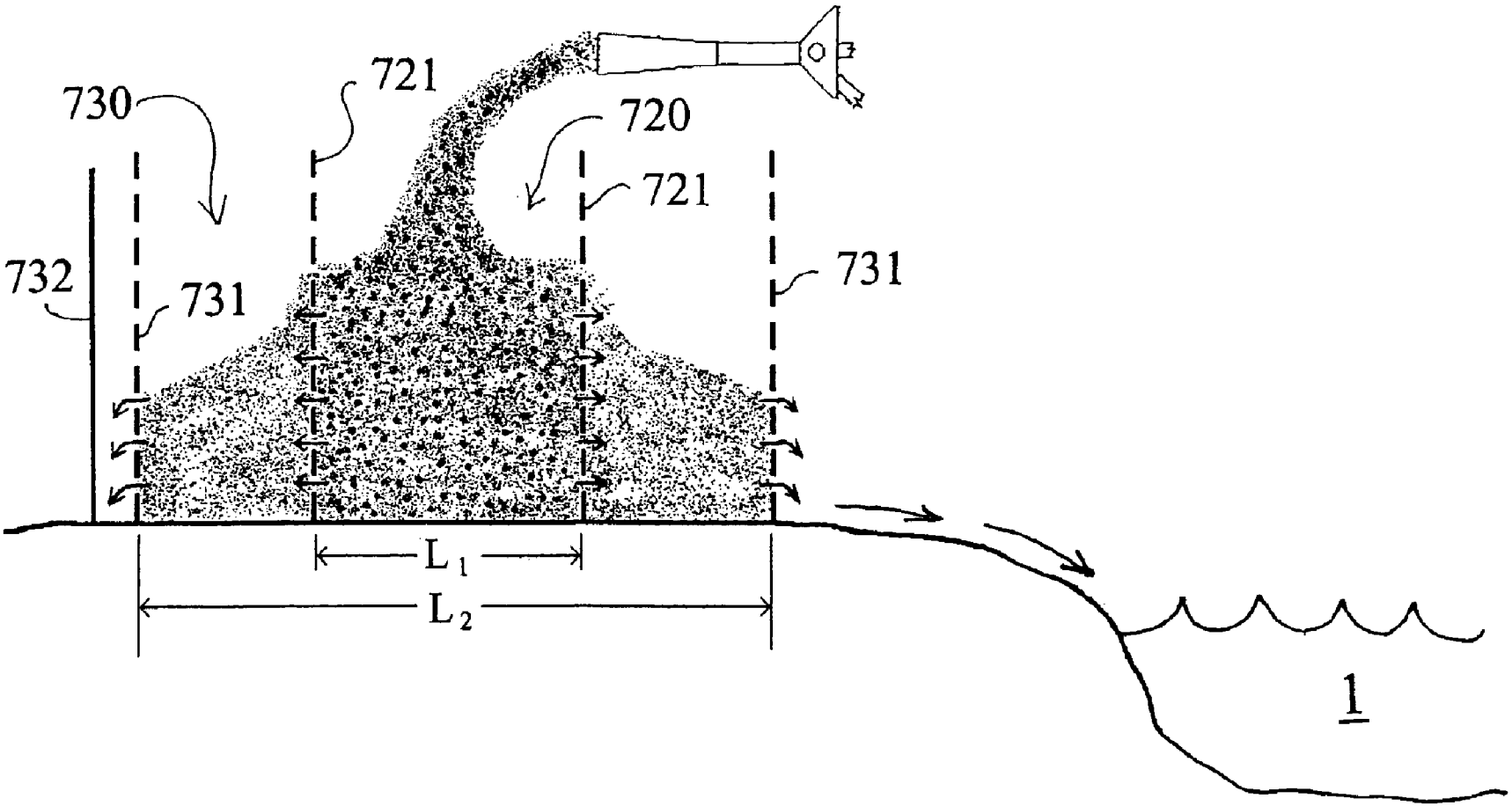
FIG. 18 is an alternate dam design utilizing two concentric dams.

FIG. 18 illustrates the use of two concentric (used broadly to mean one within another) dams or separation chambers for separating the detritus and debris from water. The dams may have any enclosed shape as noted above, i.e., circular, oval, rectangular or oblong. The inside separation chamber 720 may be the steel stakes, orange colored safety fence and square open mesh described above as forming an inner permeable dam 721. The inner dam 721 has a diameter shown as "$L_1$". A second outer separation chamber 730 is formed by an outer, or secondary, permeable dam structure 731. As a practical matter, I have found that when using two concentric semi-permeable dams, as shown in FIG. 18, it is advantageous to utilize a four foot diameter differential between $L_2$ and $L_1$. That is, if the inner dam structure 721 has a diameter of six feet, the outer dam structure 731 should have a diameter of ten feet. Similarly, if the inner dam structure has a diameter of $L_1$ of eight feet, the outer dam 731 should have a diameter $L_2$ of twelve feet. As illustrated in FIG. 18, the exterior permeable dam 731 has an impermeable plastic or other sturdy material 732 which helps direct water toward the reservoir 1. The inner dam structure 721 tends to retain debris having chunks and pieces, whereas the outer dam structure 731 tends to retain finer particles such as sand.

Figure 19:
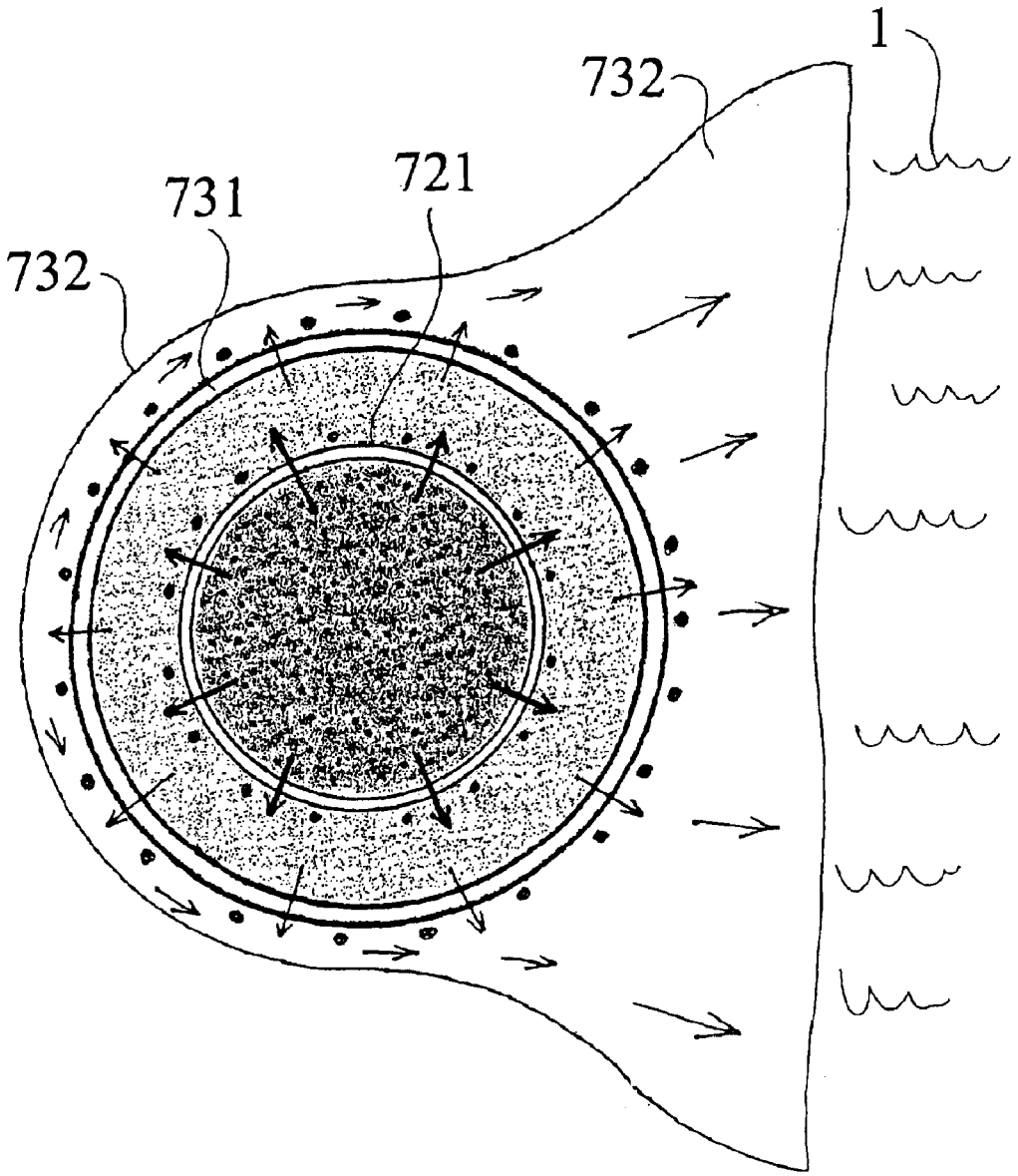
FIG. 19 is a plan view of the dams of FIG. 18.

FIG. 19 is a plan view illustrating in schematic fashion the inner, permeable dam structure 721 and the external dam structure 731. The water flowing outwardly through the secondary or exterior semi-permeable dam 731 is directed towards reservoir 1 by impermeable plastic sheet 732 which extends upwardly the full height of dam 731 around that portion of dam 731 that is furthest away from reservoir 1. The impermeable plastic sheet 732 descends downwardly and simply lays on the ground on the downhill side of the dam structure, as shown in FIG. 19, to allow the water to run over the plastic sheet 732 back towards reservoir 1.

Figure 20:
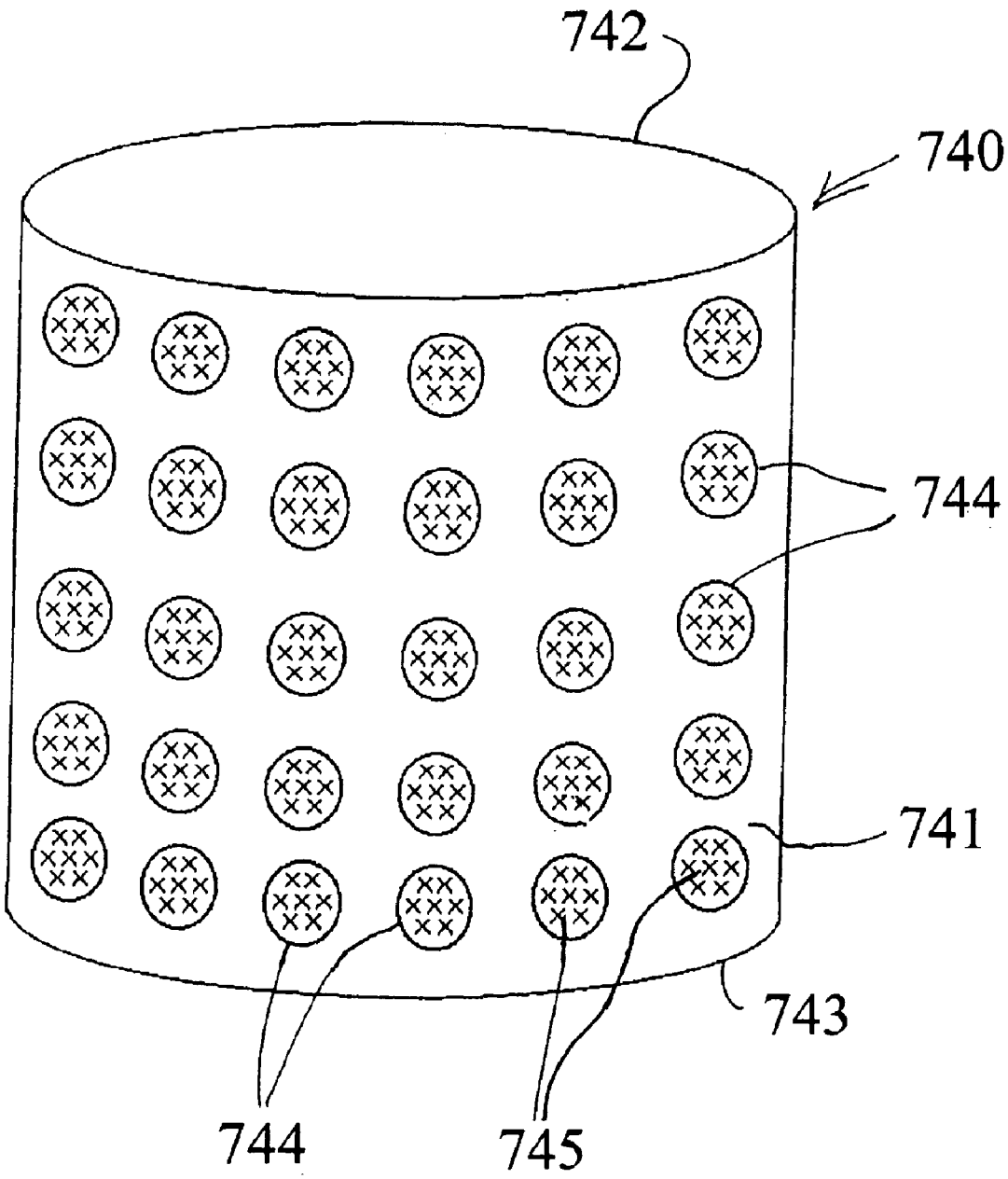
FIG. 20 is a schematic representation of a prefabricated portable dam.

FIG. 20 is a schematic representation of a prefabricated, permeable dam structure 740. The structure includes a plastic, cylindrical body 741 which is open at the top 742 and open at the bottom 743. Body 741 has numerous drain holes 744 formed therein. Each of the drain holes 744 is covered by a landscaper's cloth mesh or other suitable filtering material 745. The filtering material 745 is most conveniently attached to the inside surface of cylindrical body 741. The portable dam structure 740 forms a separation means for separating entrained debris as that entrained debris is discharged from the outlet of the eductor, as described above. The use of a prefabricated, portable dam structure may be advantageous in some applications of the invention.

Figure 30:
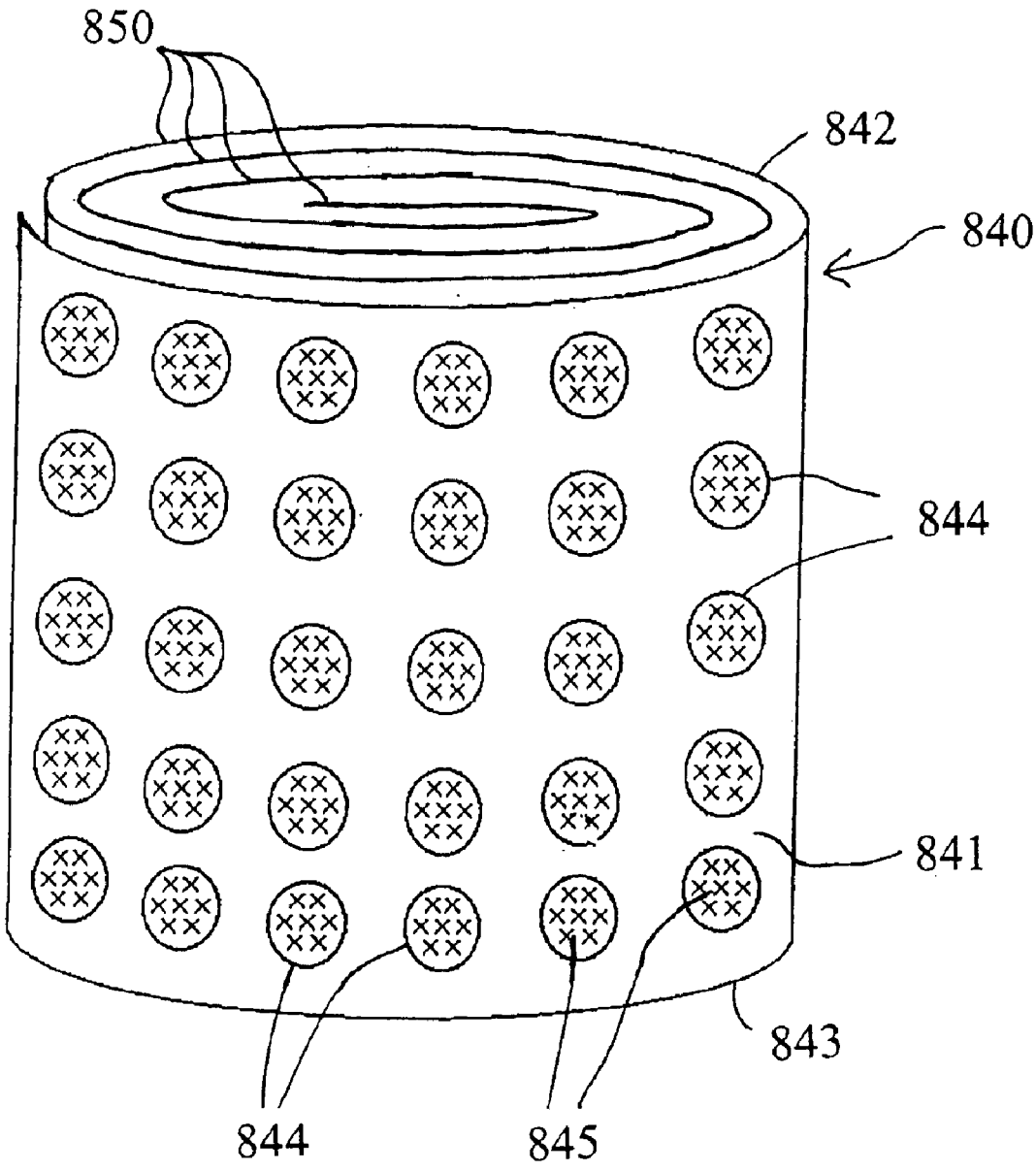
FIG. 30 is a schematic representation of an alternate portable dam structure.

As shown in FIG. 30, prefabricated structure 840 may comprise a roll of composite material 850 including drain holes 844 and filtering material 845 which is cut to size at the jobsite. That is, if a separation chamber of six feet diameter is desired, the appropriate length is cut from roll 850, the sides attached securely to withstand the weight of water and entrained debris and the chamber is placed where desired. The separation chamber will preferably be staked to the ground to hold it in place.

Figure 21:
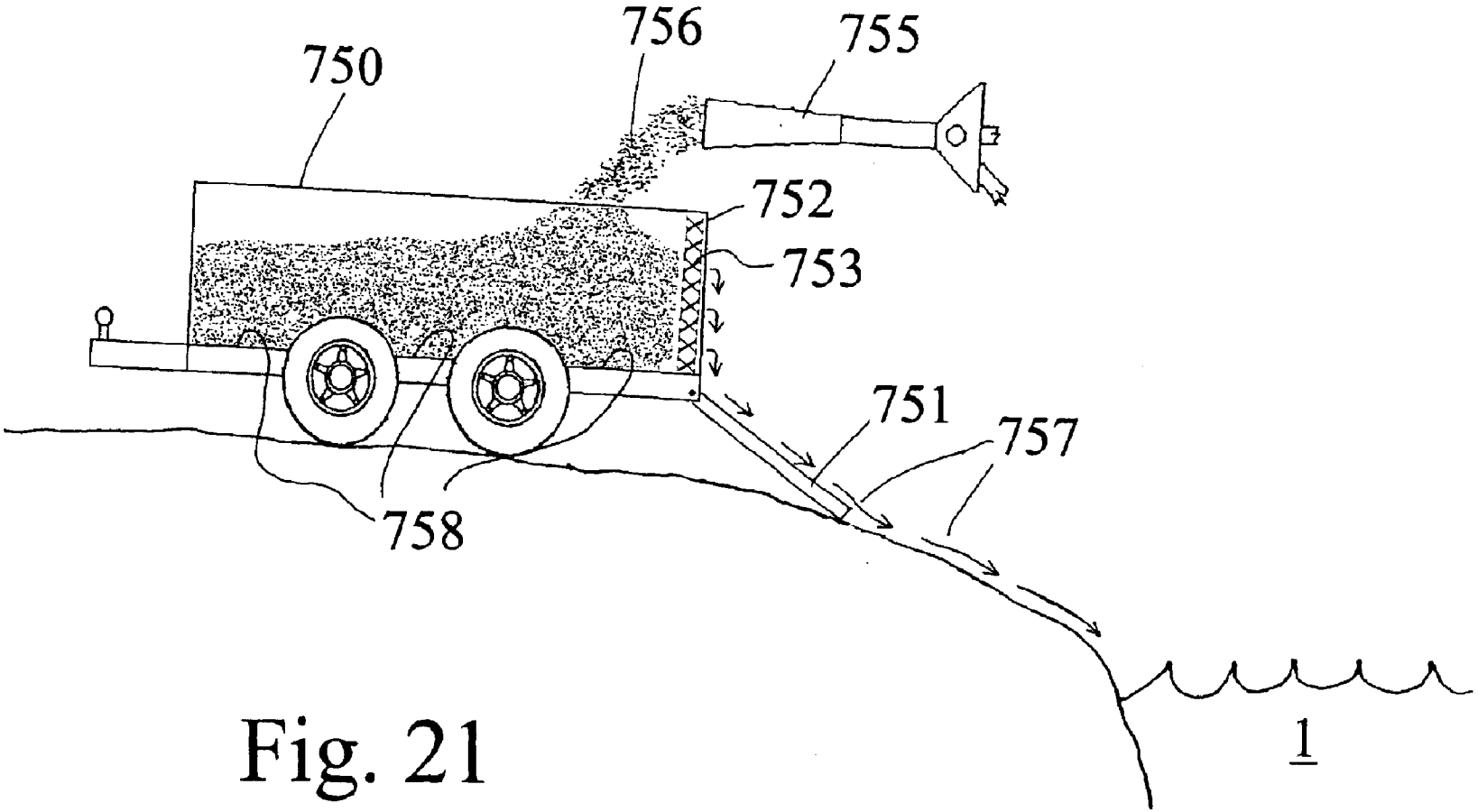
FIG. 21 is an alternate dam and separation chamber design utilizing a trailer.

FIG. 21 illustrates the use of yet another separation chamber or separation means which, as shown in FIG. 21, is a trailer 750. The rear gate 751 is lowered and the rear 752 of the trailer is covered with a suitable filtration member 753. Filtration member 753 may include, for example, the orange colored safety fence with square open mesh over which landscaper's permeable fabric has been placed and attached to the rear portion 752 of trailer 750. Eductor 755 discharges the debris 756 directly into trailer 750. Water is separated from the debris and allowed to flow back to reservoir 1, as shown by arrows 757. Alternately, trailer 750 may carry structure 740 (FIG. 20) on trailer bed 758.

Figure 22:
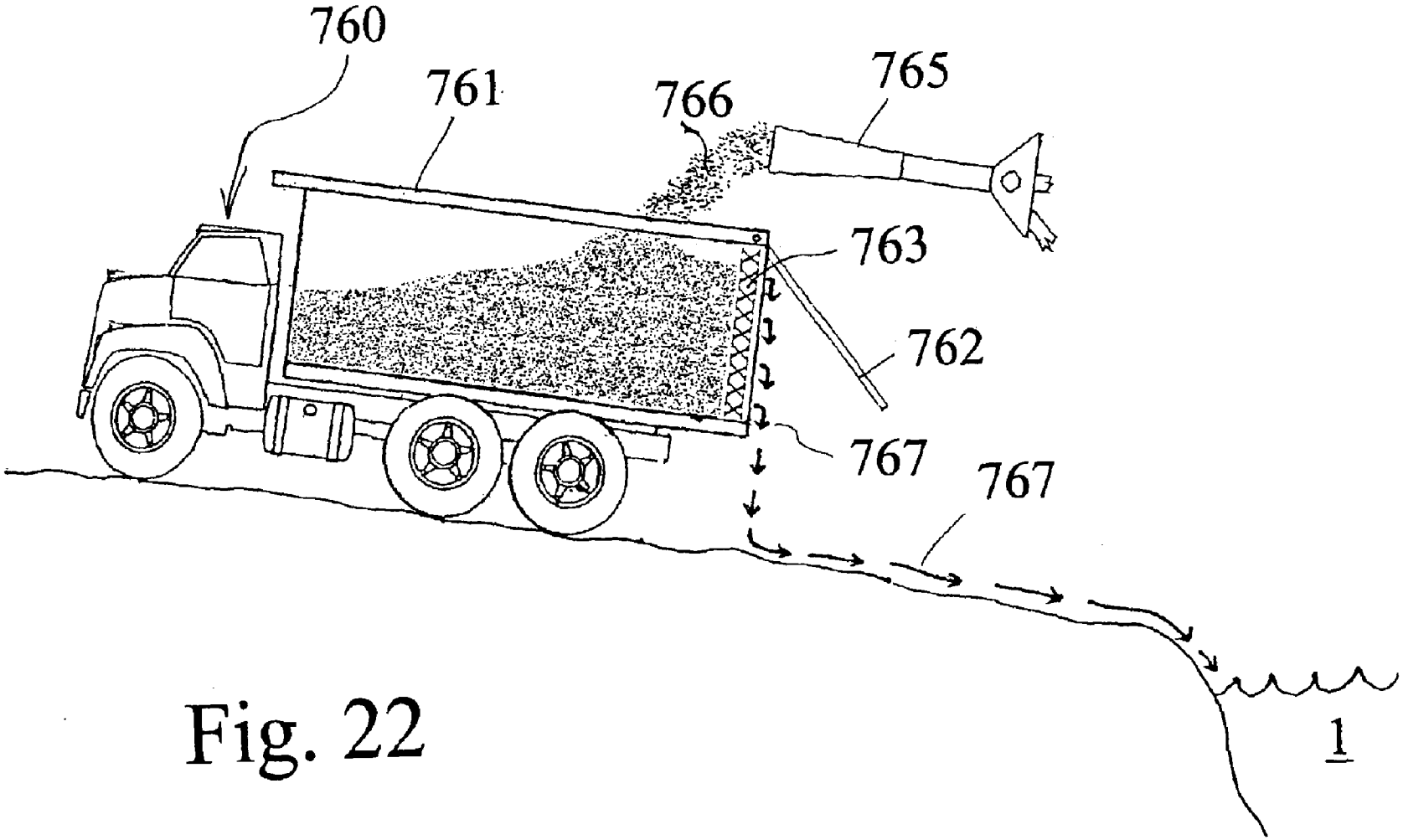
FIG. 22 is a schematic representation of yet another alternate separation chamber and dam wherein a dump truck is utilized.

Yet another type of separation means is illustrated in FIG. 22 wherein a dump truck 760 having bed 761 is utilized as the separation means. The rear gate 762 of dump truck 760 is held in the open position. A permeable filtering panel or wall 763 is attached across the rear of the open bed 761 in similar fashion to the wall 753 attached to the trailer in FIG. 21. The eductor 765 discharges the water with entrained detritus 766 into the bed 761. The water is separated from the debris and detritus by the permeable membrane 763 and is allowed to flow back into reservoir 1, as shown by arrows 767. Alternately, a structure such as 740 (FIG. 20) may be carried inside the bed 761 of dump truck 760.

Figure 23:
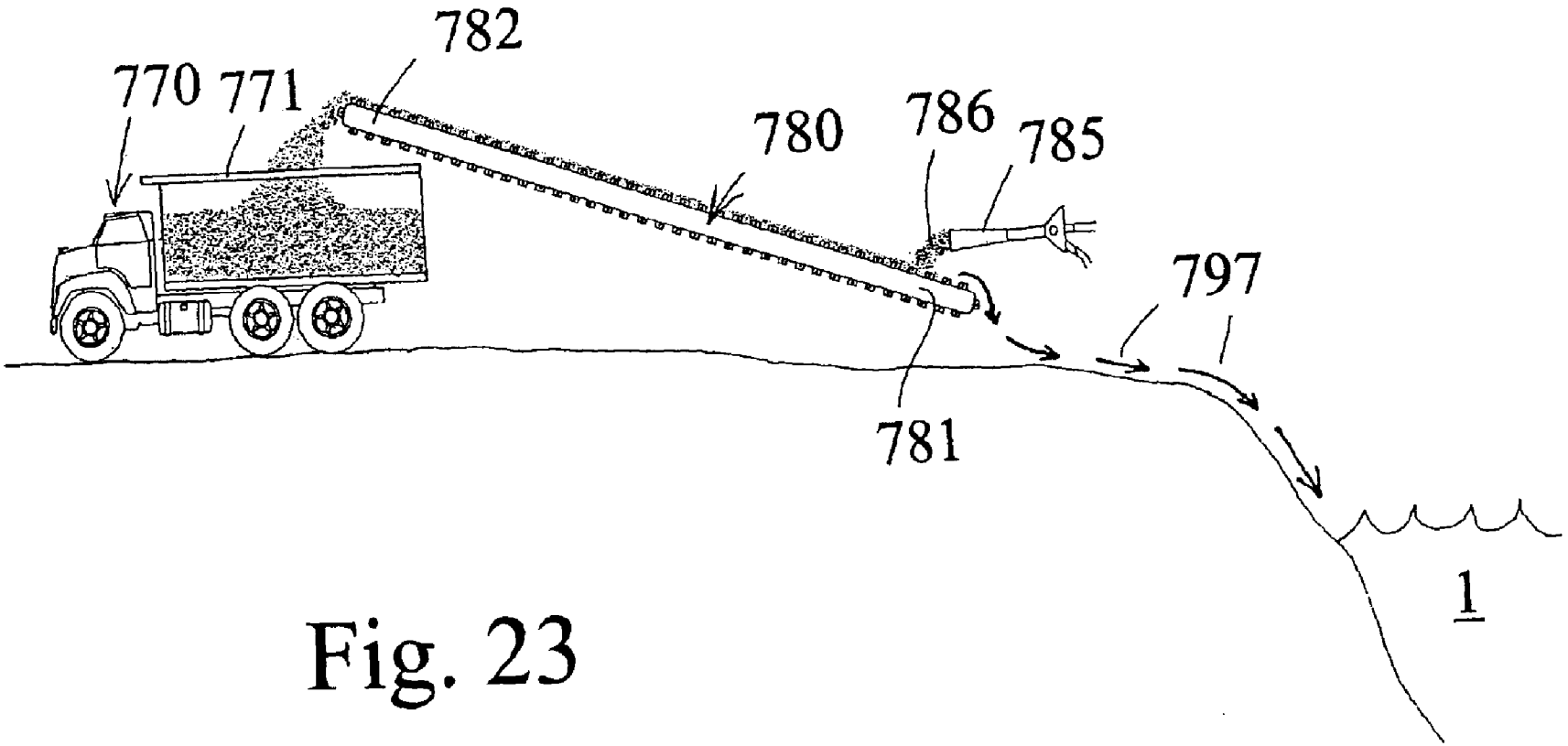
FIG. 23 is a schematic representation of a conveyor belt which is utilized as a separation device to carry the detritus and other debris upwardly to a dump truck.
Figure 24:
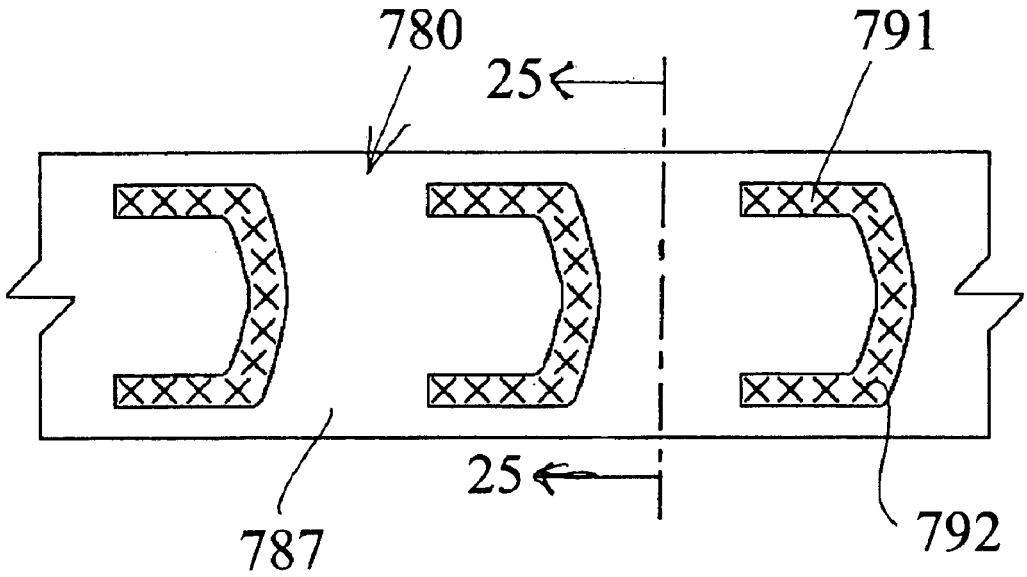
FIG. 24 is a plan view illustrating components of the conveyor illustrated in FIG. 23.
Figure 25:
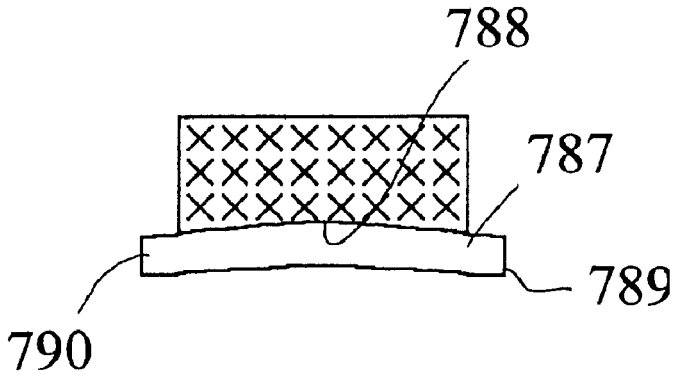
FIG. 25 is a sectional view on the line 25—25 of FIG. 24.

FIGS. 23–25 illustrate schematically the use of a dump truck 770 together with a conveyor 780. Eductor 785 discharges water and entrained debris 786 onto the lower end 781 of conveyor 780. As shown best in FIG. 24, conveyor 780 has a base 787 which is crowned upwardly in the middle, as shown best in FIG. 25, wherein the central portion 788 of bed 787 is higher than edges 789 and 790. Conveyor 780 includes a series of cleats 791, each of which is generally C-shaped and is made of permeable material 792, which is capable of filtering the detritus and debris and allowing water to run off the lower end 781 of the conveyor and back into reservoir 1, as shown by arrows 797. The separated detritus is discharged off the upper end 782 of conveyor 780 and directly into the bed 771 of dump truck 770.

Figure 26:
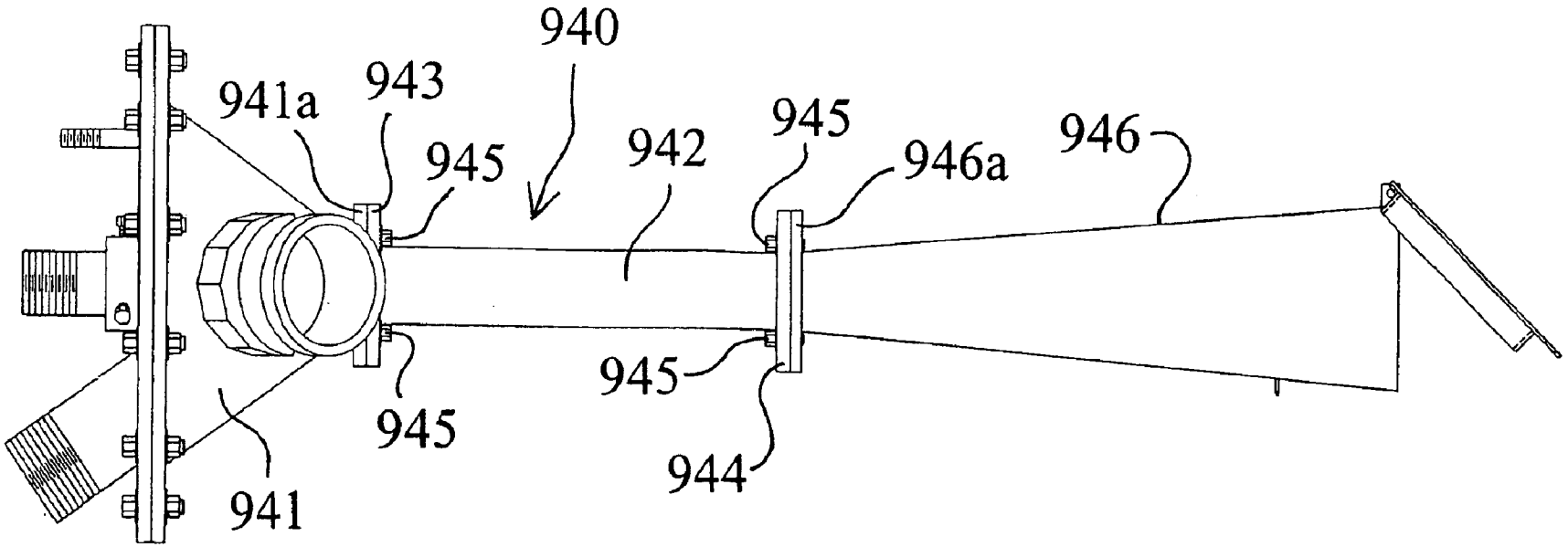
FIG. 26 is an elevational view of an alternate eductor including a stainless steel, boltable body portion.

FIGS. 26–29 illustrate a preferred eductor design and nozzle design. As shown in FIG. 26, the eductor shown generally as 940 includes a mixing chamber 941 and a discharge chamber 946, generally similar to the embodiment shown in FIGS. 7–13. However, the embodiment shown in FIGS. 26–29 includes a tubular body section 942 made of stainless steel and having flanges 943 and 944. Flanges 943 and 944 are bolted to flanges 941*a* and 946*a* attached to mixing chamber 941 and discharge 946, respectively. The bolts 945 are threaded into flanges 941*a* and 946*a* so that body section 942 may be readily replaced in the field. The stainless steel, boltable body section 942 is more resistant to abrasion and more easily replaced than the threaded and aluminum body 45 of the embodiment shown in FIGS. 7–13. The dimensions shown in FIGS. 11–13 are hereby incorporated by reference as though set forth in full herein.

Figure 27:
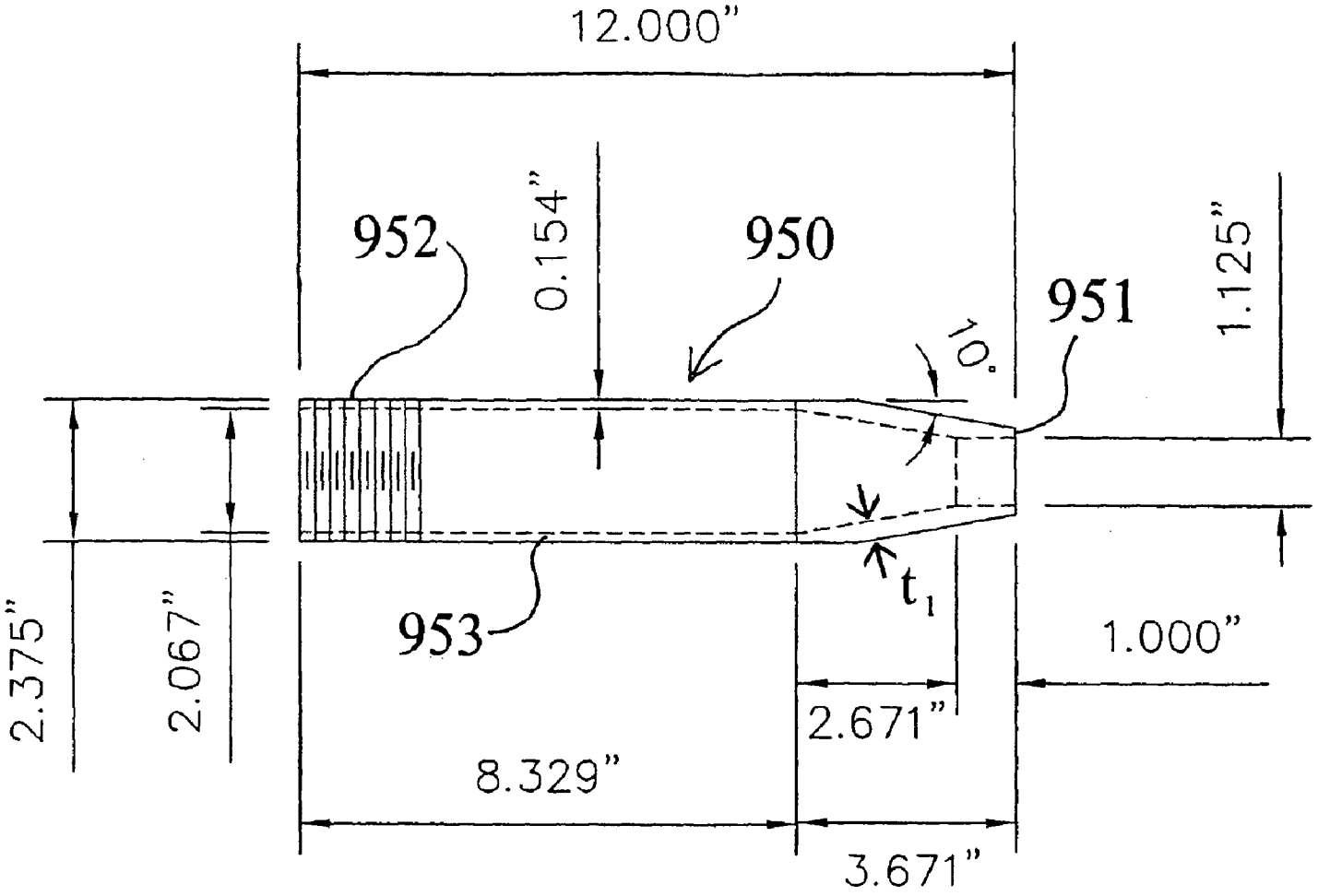
FIG. 27 is an elevational view of an alternate nozzle made of stainless steel.

FIG. 27 is an elevational view of a further improved nozzle design from that shown in FIGS. 8A and 12. The significant improvements are that the nozzle 950, shown in FIG. 27, is made of stainless steel in order to increase its resistance to the abrasive effect of the debris flowing past the nozzle. Secondly, the nozzle tip 951 has an increased wall thickness $t_1$ wherein the thickness $t_1$ is at least twice as great as the wall thickness of stainless steel tube 953, which as shown is 0.154 inch. All of the dimensions shown on FIG. 27 are herein incorporated by reference as if set forth in full. The nozzle tip 951 has an opening of the same dimension, i.e., 1.125 inch as the nozzle shown and described in FIG. 8B and FIG. 12. The increased thickness of tip 951 increases the longevity of nozzle 950 by increasing its resistance to the abrasive effects of the debris flowing past it. Nozzle 950 has a proximal end 952 which is threaded to threadably engage the high pressure water line.

FIGS. 28 and 29 show how the cover 960 for the mixing chamber or eductor housing carries nozzle 950. A central passageway 961 is formed in a hub 965. Passageway 961 slidably carries nozzle 950. A series of three tapped holes 962,963,964 extend through hub 965 and receive threaded set screws (not shown for clarity) which tighten on to the outer surface of nozzle 50 and hold it in place. The position of nozzle 950 relative to hub 965 is adjusted by loosening set screws carried in holes 962–964, slidably adjusting the nozzle 950 and retightening the set screws 962–964. Hub 965 has a pair of recesses 968 and 969 formed in passageway 961 for receiving O-ring seals (not shown for clarity). The seals maintain the vacuum within the mixing chamber during operation of the eductor 940.

The foregoing description of the invention has been presented for purposes of illustration and description and is not intended to be exhaustive or to limit the invention to the precise form disclosed. For example, the size of the pump, eductor and vacuum line may be increased to handle larger particles of debris, although the equipment then becomes heavier. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. In a golf course recirculating irrigation system including a reservoir, the improvement comprising an apparatus for removing underwater debris from said reservoir of said golf course recirculating irrigation system by entraining said debris in water and pumping said entrained debris out of said reservoir, comprising:

eductor means for vacuuming said debris out of said reservoir, said eductor means including a high pressure water inlet, a vacuum line inlet and an outlet, said vacuum line having a first end connected to said eductor means, said vacuum line having a second end movable in said reservoir, pump means for driving said eductor means, said pump means having an inlet line connected to a source of water, and said pump means having an outlet line connected to said eductor means to deliver high pressure water to said eductor means, whereby said second end of said vacuum line is adapted to remove said debris from said reservoir entrained in water from said reservoir, and is adapted to carry said entrained debris to said eductor means, and separation means for separating said entrained debris from the water in which said debris is entrained as said entrained debris is discharged from the outlet of said eductor means.

2. The apparatus of claim 1 wherein said separation means comprises a temporary, permeable dam through which water passes freely but which traps and separates said debris from the water in which it was entrained.

3. The apparatus of claim 2 wherein said permeable dam is enclosed.

4. The apparatus of claim 1 wherein said separation means comprises two concentric, permeable dams.

5. The apparatus of claim 2 wherein said permeable dam comprises a plurality of steel stakes driven into the ground, a layer of open mesh plastic attached to said stakes, and a layer of fine mesh fabric adjacent said layer of open mesh plastic.

6. The apparatus of claim 1 wherein said separation means comprises a prefabricated, plastic cylinder, said cylinder having a plurality of drain holes formed therein, and a fine mesh filter covering said plurality of drain holes.

7. The apparatus of claim 1 wherein said separation means comprises:

a trailer, a permeable dam carried by said trailer for separating said debris from the water in which it is entrained.

8. The apparatus of claim 7 wherein said permeable dam extends across the back of said trailer.

9. The apparatus of claim 7 wherein said permeable dam is carried on the bed of said trailer.

10. The apparatus of claim 1 wherein said separation means comprises:

a dump truck, a permeable dam carried by the bed of said dump truck.

11. The apparatus of claim 10 wherein said permeable dam extends across the back of the bed of said dump truck.

12. The apparatus of claim 10 wherein said permeable dam is carried on the bed of said dump truck.

13. The apparatus of claim 1 wherein said separation means comprises:

a conveyor, a plurality of permeable members carried by said conveyor.

14. The apparatus of claim 13 wherein said conveyor is domed along its longitudinal center.

15. The apparatus of claim 1 further comprising:

a clean out carried by said eductor means adapted to allow a user to readily clear a clog in said eductor means.

16. The apparatus of claim 1 wherein said eductor means further comprises a conical mixing chamber, a cover for said mixing chamber, a nozzle slidably carried by said cover, and means for adjusting the position of said nozzle in said mixing chamber.

17. The apparatus of claim 1 wherein said eductor means has an outlet and a priming flap carried by said outlet.

18. The apparatus of claim 1 further comprising:

injector means connected to said vacuum line to inject water into said vacuum line to increase the flow rate of water and entrained debris in said vacuum line.

19. The apparatus of claim 1 further comprising a collection chamber positioned in said vacuum line to separate out relatively large pieces of debris that may otherwise clog said eductor means.

20. The apparatus of claim 19 wherein said collection chamber comprises:

an elongated, vertically extending body, a removable cap carried by the top of said body, a removable separation cage carried inside said body, said cage adapted to trap large pieces of debris that may otherwise clog said eductor means.

21. The apparatus of claim 1 wherein said eductor means includes a plurality of eductors, each having its own separate vacuum line.

* * * * *